US011739728B2

(12) United States Patent
Maruyama et al.

(10) Patent No.: US 11,739,728 B2
(45) Date of Patent: Aug. 29, 2023

(54) WAVE RECEIVING MECHANISM

(71) Applicants: THE UNIVERSITY OF TOKYO, Tokyo (JP); KAWASAKI JUKOGYO KABUSHIKI KAISHA, Kobe (JP)

(72) Inventors: Koki Maruyama, Tokyo (JP); Chang-Kyu Rheem, Tokyo (JP); Hidetaka Kobayashi, Tokyo (JP); Naoki Kuribayashi, Kobe (JP)

(73) Assignees: THE UNIVERSITY OF TOKYO, Tokyo (JP); KAWASAKI JUKOGYO KABUSHIKI KAISHA, Kobe (JP)

( * ) Notice: Subject to any disclaimer, the term of this patent is extended or adjusted under 35 U.S.C. 154(b) by 649 days.

(21) Appl. No.: 16/968,427

(22) PCT Filed: Feb. 6, 2019

(86) PCT No.: PCT/JP2019/004194

§ 371 (c)(1),
(2) Date: Aug. 7, 2020

(87) PCT Pub. No.: WO2019/156109

PCT Pub. Date: Aug. 15, 2019

(65) Prior Publication Data

US 2020/0400115 A1 Dec. 24, 2020

(30) Foreign Application Priority Data

Feb. 7, 2018 (JP) ..... 2018-020013

(51) Int. Cl.
*F03B 13/18* (2006.01)

(52) U.S. Cl.
CPC ..... *F03B 13/182* (2013.01); *F03B 13/181* (2013.01); *F05B 2210/11* (2013.01); *F05B 2240/91* (2013.01)

(58) Field of Classification Search
CPC ..... F03B 13/12; F03B 13/181; F03B 13/182; F03B 13/186; F03B 13/22; F03B 13/1805;
(Continued)

(56) References Cited

U.S. PATENT DOCUMENTS

2011/0084488 A1* 4/2011 Eder ..... F03B 13/186 290/53
2014/0152015 A1* 6/2014 Sidenmark ..... E02B 9/08 290/53

FOREIGN PATENT DOCUMENTS

JP S59-013678 U 1/1984
JP H04-160261 A 6/1992
(Continued)

OTHER PUBLICATIONS

Osaka, "Introduction of Wave Energy Absorption Straightening"—Mach. Trans. ( JP59013678U.en.pdf), Jan. 1984 (Year: 1984).*

*Primary Examiner* — Kenneth J Hansen
(74) *Attorney, Agent, or Firm* — Oliff PLC

(57) ABSTRACT

A wave receiving mechanism includes: a shaft driving a hydraulic pump; and a wave receiving member including an arm and wave receiving plate, the arm unrotatably attached to the shaft, the plate being at the arm receiving a wave force, the wave receiving member swinging about the shaft by receiving the wave force and turning the shaft turn. The arm includes first and second arm portions, and a bendable portion, the first arm portion unrotatably attached to the shaft, the second arm portion being at the plate, the bendable portion coupling the first and second arm portions. When a swing angle of the first arm portion is less than a first predetermined angle, the bendable portion makes the arm portions swing integrally. When the swing angle of the first
(Continued)

arm portion is the predetermined angle, the bendable portion allows the second arm portion to bend relative to the first.

16 Claims, 13 Drawing Sheets

(58) Field of Classification Search
CPC ..... F03B 13/189; F05B 2210/11; F05B 2260/406; F05B 2250/411; F05B 2270/1077
USPC ..... 464/69; 417/330; 60/506, 497
See application file for complete search history.

(56) References Cited

FOREIGN PATENT DOCUMENTS

| | | | | |
|---|---|---|---|---|
| JP | 2015-108344 | A | | 6/2015 |
| JP | 2015108344 | A | * | 6/2015 |

* cited by examiner

WAVE RECEIVING MECHANISM

TECHNICAL FIELD

The present invention relates to a wave receiving mechanism configured to receive the force of waves to swing and thereby drive a hydraulic pump.

BACKGROUND ART

Natural energy power generation systems which utilize various natural energies, such as wind energy and solar energy, are being put into practical use, and a wave power generation system is known as one of the natural energy power generation systems. The wave power generation system converts the force of waves, i.e., wave energy into mechanical energy and further converts the mechanical energy into electric energy. One example of the wave power generation system having such functions is a wave power generation system disclosed in PTL 1, for example.

In the wave power generation system of PTL 1, a shaft is supported by a pair of bearing members so as to be turnable, and a wave receiving member is attached to the shaft so as not to be turnable relative to the shaft. Therefore, when the wave receiving member swings, the shaft turns toward one side or the other side in a circumferential direction of the shaft. The shaft is coupled to a pump device. The pump device is a ram cylinder pump. To be specific, by the turn of the shaft toward one side or the other side in the circumferential direction, a rod reciprocates, and with this, the pump device discharges an operating liquid. The discharged operating liquid is supplied to a hydraulic motor, and the hydraulic motor rotates its output shaft by the supplied operating liquid. A power generator is attached to the output shaft of the hydraulic motor and generates electric power by the rotation of the output shaft.

CITATION LIST

Patent Literature

PTL 1: Japanese Laid-Open Patent Application Publication No. 2015-108344

SUMMARY OF INVENTION

Technical Problem

In the wave power generation system of PTL 1, when the wave receiving member receives the force of waves, the rod strokes by an amount corresponding to the force of the waves, and the pump device discharges the operating liquid at a flow rate corresponding to the stroke amount. The flow rate of the operating liquid discharged from the pump device is determined depending on a discharge capacity of the pump device. The discharge capacity of the pump device used is determined as below.

To be specific, the wave received by the wave receiving member is natural energy. Therefore, the height of the wave is not constant and changes from moment to moment. On this account, the wave power generation system needs to deal with waves of any height. In order to deal with the waves of any height, the capacity of the pump device is determined such that an operation efficiency of the wave power generation system becomes the highest with respect to the waves of any height. However, it is actually difficult to deal with all the waves of any height. Therefore, the capacity of the pump device is actually determined in accordance with the wave of a height which is high in occurrence frequency among the heights of the waves generated. However, in some cases, the wave receiving member receives waves higher than expected waves. In such cases, the wave receiving member swings largely, so that various components, such as the pump device, in the wave power generation system may be damaged.

In order to deal with such situations, the wave power generation system includes a stopper by which even when the wave receiving member receives high waves, the wave receiving member does not swing beyond an expected angle. When the wave receiving member swings at a predetermined angle, the stopper contacts the wave receiving member. The swinging of the receiving member is restricted by this contact of the stopper. Thus, it is possible to prevent a case where the rod strokes more than expected, and therefore, the pump device is damaged. However, since the swinging of the wave receiving member is restricted by the stopper, the wave receiving member needs to receive the entire force of the waves. If the wave receiving member is configured to be able to endure such force of the waves, the wave receiving mechanism increases in size, and the manufacturing cost increases. Therefore, in order to prevent the wave receiving member from being damaged, the wave receiving member is desired to be configured to be able to parry the high force of the waves when the high force of the waves acts on the wave receiving member.

An object of the present invention is to provide a wave receiving mechanism capable of parrying high force of waves when the high force of the waves acts on a wave receiving member.

Solution to Problem

A wave receiving mechanism of the present invention includes: a shaft connected to a hydraulic pump and supported so as to be turnable, the shaft being configured to drive the hydraulic pump by turning toward a first side or second side in a circumferential direction; and a wave receiving member including an arm and a wave receiving plate, the arm being attached to the shaft so as to be unrotatable relative to the shaft, the wave receiving plate being provided at the arm so as to receive force of waves, the wave receiving member being configured to swing about the shaft by receiving the force of the waves and make the shaft turn by the swinging. The arm includes a first arm portion, a second arm portion, and a bendable portion, the first arm portion being attached to the shaft so as to be unrotatable relative to the shaft, the second arm portion being provided at the wave receiving plate, the bendable portion being configured to couple the first arm portion and the second arm portion to each other. When a swing angle of the first arm portion is less than a first predetermined angle, the bendable portion makes the first arm portion and the second arm portion swing integrally. When the swing angle of the first arm portion is the predetermined angle, the bendable portion allows the second arm portion to bend relative to first arm portion.

According to the present invention, when the swing angle of the first arm portion is less than the predetermined angle, the first arm portion and the second arm portion swing integrally. Therefore, the force of the waves can be transmitted to the shaft, and the hydraulic pump can be driven by the force. On the other hand, when the swing angle of the first arm portion reaches the predetermined angle due to the high force of the waves, the second arm portion is bent relative to the first arm portion. With this, the wave receiving plate can parry the force of the waves, and therefore, excessive force can be prevented from acting on the wave receiving plate. To be specific, the wave receiving member can be prevented from being damaged. With this, the wave receiving mechanism which can endure large waves can be manufactured without increasing the size of the wave receiving mechanism.

Moreover, according to the present invention, the force of the waves can be parried by bending the second arm portion. Therefore, the force of the large waves can be prevented from being transmitted from the wave receiving plate through the second arm portion and the first arm portion to the shaft, and the shaft and the hydraulic pump can be prevented from being damaged by the force of the large waves.

In the above invention, the bendable portion may include an engaging portion and an engaged portion, the engaging portion being provided at one of the first arm portion and the second arm portion, the engaged portion being provided at the other of the first arm portion and the second arm portion and configured to be engaged with the engaging portion. When the engaging portion and the engaged portion are engaged with each other, the bendable portion may make the first arm portion and the second arm portion swing integrally. When the engaging portion and the engaged portion are disengaged from each other, the bendable portion may allow the second arm portion to bend relative to the first arm portion.

According to the above configuration, the bending of the second arm portion relative to the first arm portion can be allowed only by a simple operation of disengaging the engaging portion and the engaged portion from each other. Therefore, the number of parts of the wave receiving mechanism and the manufacturing cost can be prevented from increasing.

In the above invention, the wave receiving mechanism may further include a disengaging member configured to: contact the bendable portion of the swinging wave receiving member; and when the first arm portion swings with the disengaging member contacting the bendable portion, make the engaging portion and the engaged portion be displaced relative to each other, and with this, disengage the engaging portion and the engaged portion from each other.

According to the above configuration, when the first arm portion swings to reach the predetermined angle with the disengaging member contacting the bendable portion, the engaging portion and the engaged portion are automatically disengaged from each other. Therefore, the disengaging member does not have to have complex functions for realizing the disengagement and can be configured simply.

In the above invention, a portion of one of the engaging portion and the engaged portion may include a roller supported so as to be turnable, the other of the engaging portion and the engaged portion being engaged with the portion of the one of the engaging portion and the engaged portion. When disengaging the engaging portion and the engaged portion from each other, the roller may roll on the other of the engaging portion and the engaged portion.

According to the above configuration, the roller can roll on the other of the engaging portion and the engaged portion. Therefore, it is possible to prevent a case where the engagement is kept, and the bending is inhibited.

In the above invention, the wave receiving mechanism may further include a stopper member configured to, when the first arm portion swings at a second predetermined angle that is the first predetermined angle or more, contact the first arm portion to restrict the swinging of the first arm portion.

According to the above configuration, it is possible to prevent a case where the first arm portion continuously swings even after the bending of the second arm portion, and the shaft further turns.

In the above invention, the wave receiving mechanism may further include a flexible joint by which a wave receiving shaft that is the shaft and a pump shaft of the hydraulic pump are coupled to each other such that an axis of the wave receiving shaft and an axis of the pump shaft are parallel to each other. The flexible joint may allow the wave receiving shaft to be displaced relative to the pump shaft in directions perpendicular to the axis.

According to the above configuration, even when the wave receiving shaft is bent or twisted since the wave receiving member receives the force of the waves, such bending or twisting can be absorbed by the flexible joint. With this, even when the wave receiving shaft is bent or twisted, the wave receiving shaft and the pump shaft can be prevented from being damaged.

Advantageous Effects of Invention

According to the present invention, when the force of large waves acts on the wave receiving member, the wave receiving member can parry the force of the large waves.

DESCRIPTION OF EMBODIMENTS

Hereinafter, a wave power generation system 1 according to an embodiment of the present invention will be described with reference to the drawings. It should be noted that directions stated in the following description are used for convenience sake, and directions and the like of components of the present invention are not limited. Moreover, the wave power generation system 1 described below is just one embodiment of the present invention. Therefore, the present invention is not limited to the embodiment. Additions, deletions, and modifications may be made within the scope of the present invention.

Wave Power Generation System

Figure 1:
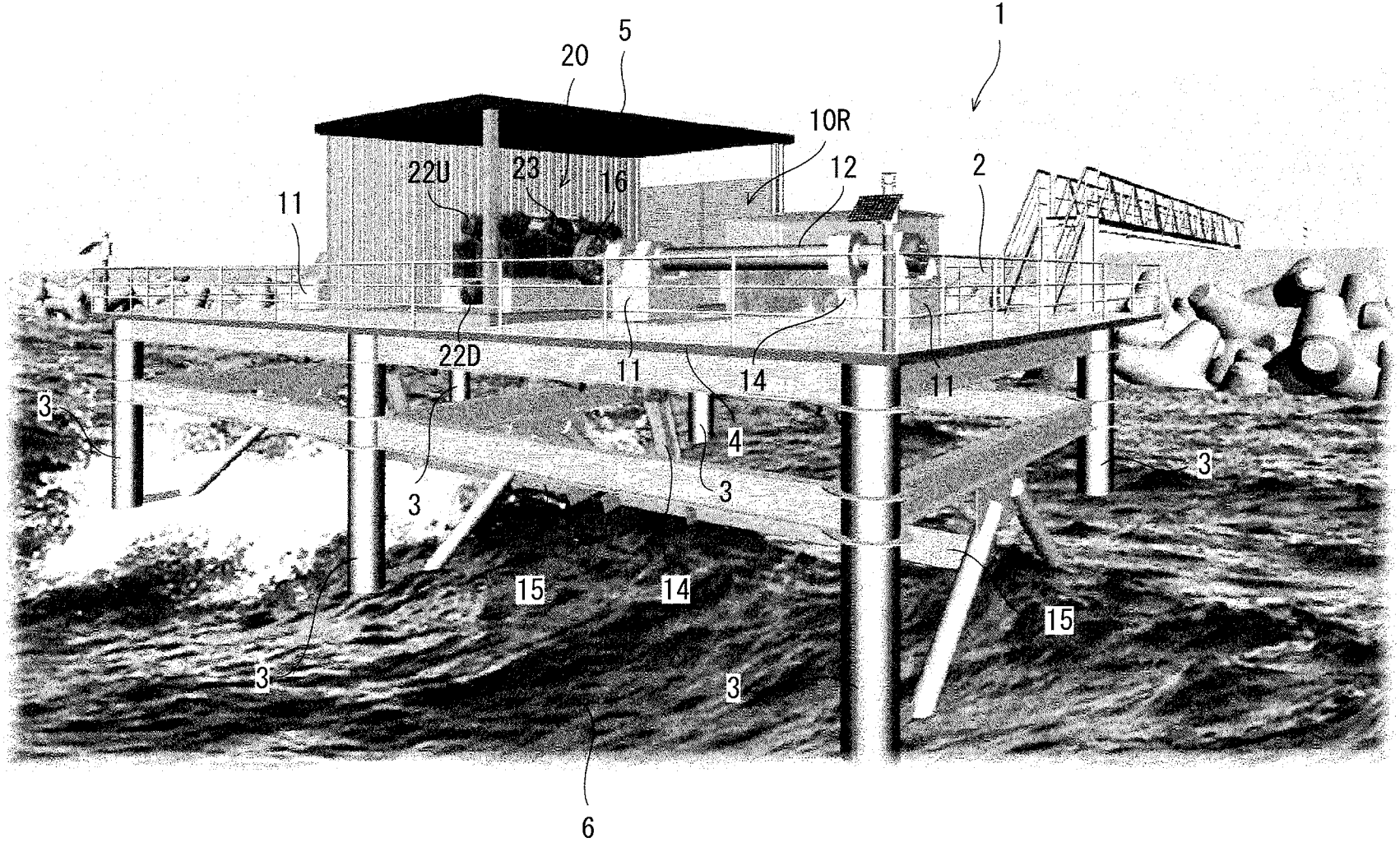
FIG. 1 is a perspective view showing a wave power generation system of Embodiment 1.
Figure 2:
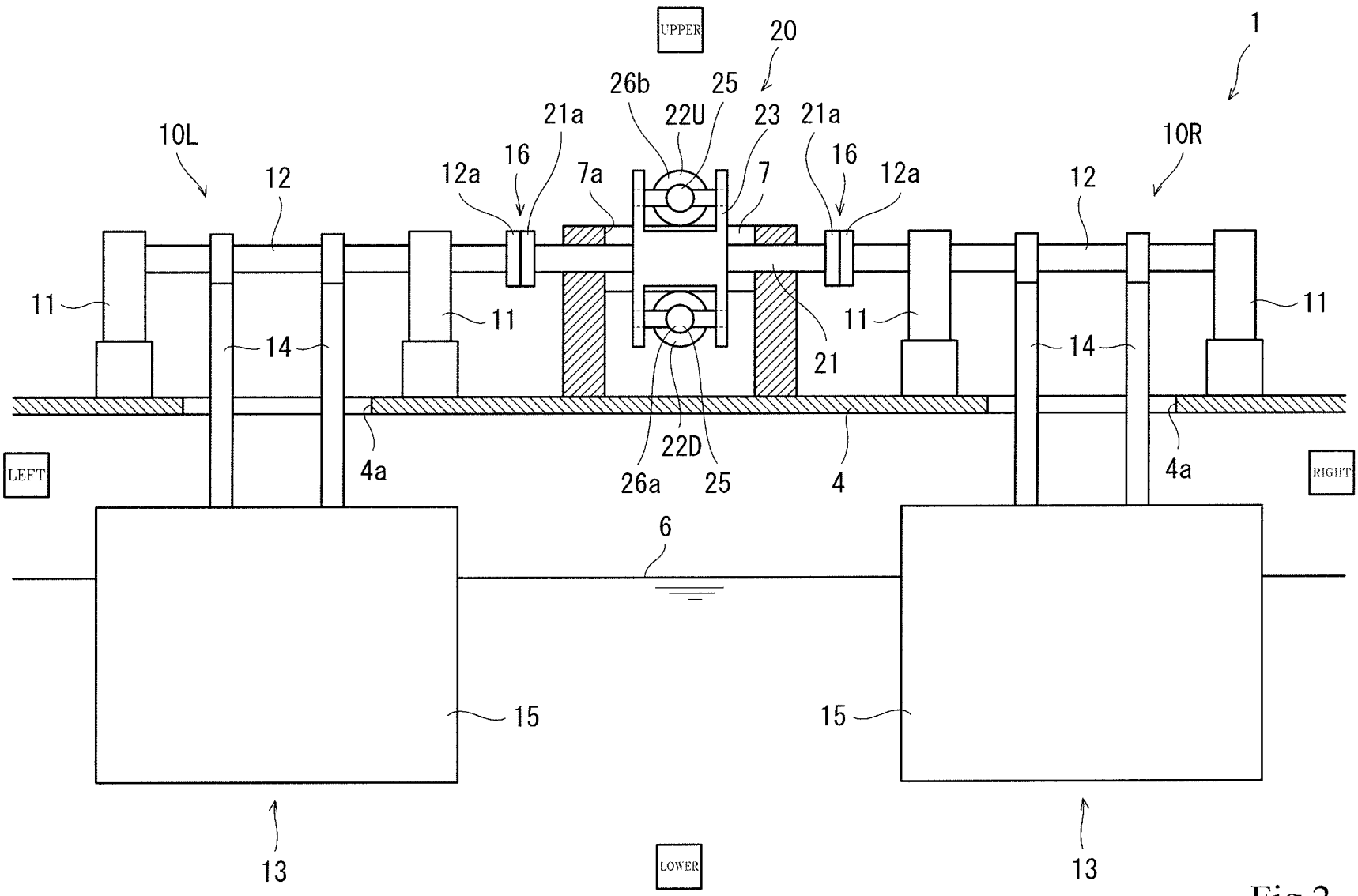
FIG. 2 is a front view schematically showing the wave power generation system of FIG. 1.
Figure 3:
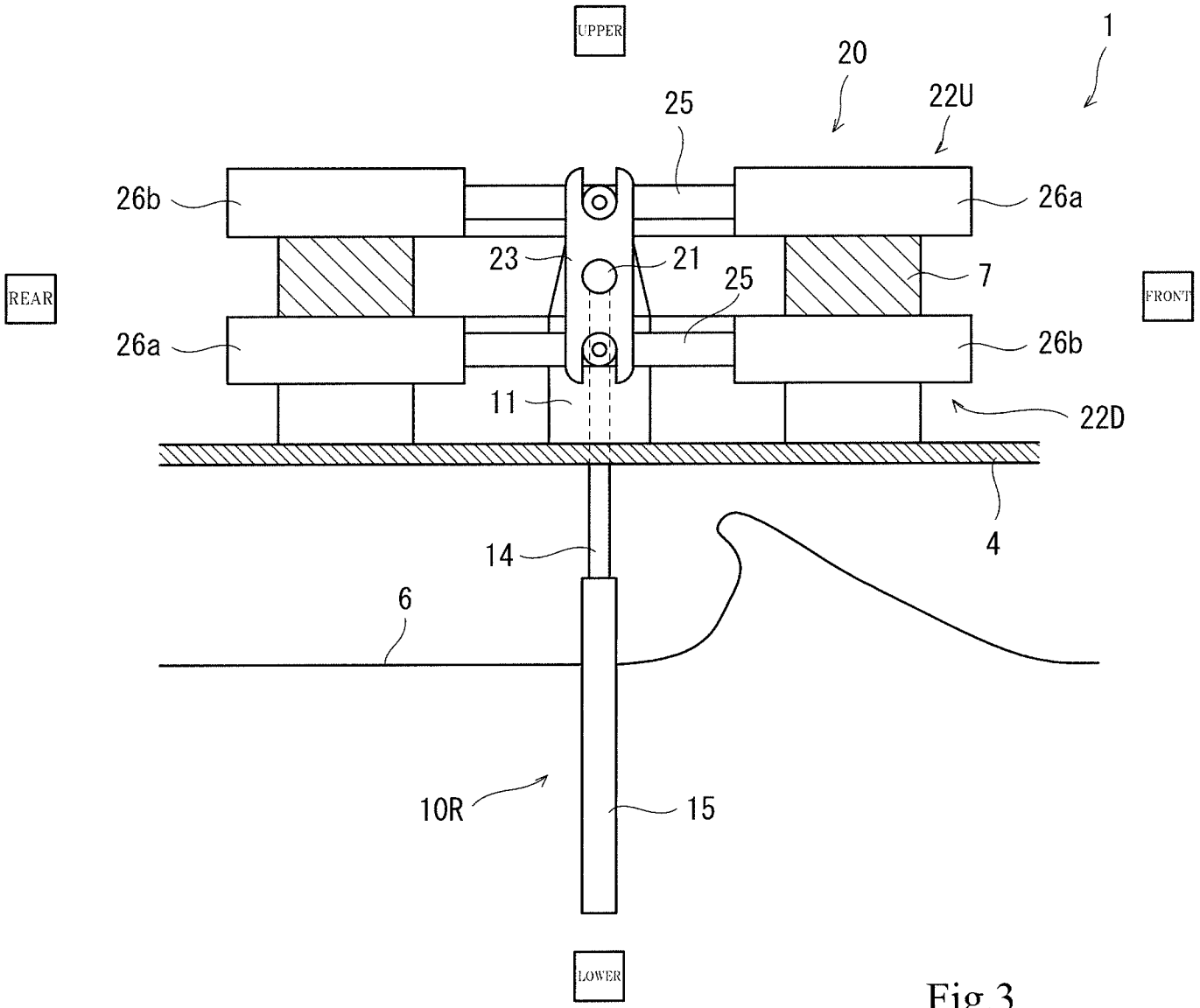
FIG. 3 is a side view of the wave power generation system of FIG. 2 when viewed from a lateral side.

The wave power generation system 1 shown in FIG. 1 is a power generation system configured to generate electric power by converting the force of waves breaking on a shore into electric energy, i.e., converting wave energy into electric energy. The wave power generation system 1 is provided in front of a breakwater 2 provided on the shore (i.e., at the offing side of the breakwater 2). Specifically, a concrete sinker is provided on a seabed in the vicinity of the breakwater 2, and a plurality of (six, for example) post piles 3 stand on the concrete sinker. A floor panel 4 having a substantially rectangular shape in a plan view is placed on and fixed to the plurality of post piles 3, and a waterproof cabin 5 is provided on the floor panel 4. The waterproof cabin 5 accommodates part (such as a below-described pump device 20) of components of the wave power generation system 1. The wave power generation system 1 arranged as above is configured as a steel marine jacket structure. In order to convert the wave energy into the electric energy, the wave power generation system 1 includes a pair of pendulum wave receiving mechanisms 10L and 10R as shown in FIGS. 2 and 3.

Wave Receiving Mechanism

The pair of wave receiving mechanisms 10L and 10R are provided at the floor panel 4 so as to be located away from each other in, for example, a direction (left-right direction on the paper surface) substantially perpendicular to the waves breaking on the shore. The pair of wave receiving mechanisms 10L and 10R are the same in configuration as each other. Therefore, the following will describe the configuration of the wave receiving mechanism 10R. Regarding the wave receiving mechanism 10L, the same reference signs are used for the same components, and a repetition of the same explanation is avoided. In order to swing by receiving the force of the waves breaking on the shore, the wave receiving mechanism 10R includes a pair of support bases 11, a rudder shaft 12, and a wave receiving member 13. The pair of support bases 11 are provided at the floor panel 4 so as to be located away from each other in the left-right direction. The rudder shaft 12 is inserted into the pair of support bases 11. The rudder shaft 12 is a long, substantially columnar member and extends in the left-right direction. One end portion and the other end portion of the rudder shaft 12 are supported by the pair of support bases 11 such that the rudder shaft 12 is turnable. The wave receiving member 13 is attached to an intermediate portion of the rudder shaft 12.

The wave receiving member 13 swings by receiving the waves breaking on the shore, and thereby makes the rudder shaft 12 turn. The wave receiving member 13 having this function includes a pair of arms 14 and a wave receiving plate 15. The pair of arms 14 are long members extending in an upper-lower direction. Upper end portions of the arms 14 are attached to the rudder shaft 12 such that the arms 14 are unrotatable relative to the rudder shaft 12. The pair of arms 14 are attached to the rudder shaft 12 so as to be located away from each other in the left-right direction. The floor panel 4 includes an opening 4*a* which is located under the rudder shaft 12 and between the pair of support bases 11. The pair of arms 14 hang down from the rudder shaft 12 through the opening 4*a* toward a sea surface 6. Lower end portions of the pair of arms 14 arranged as above reach the vicinity of the sea surface 6, and the wave receiving plate 15 is provided at the lower end portions of the pair of arms 14.

The wave receiving plate 15 is a plate having a substantially rectangular shape when viewed from a rear side (i.e., from the breakwater 2 side). Most of the wave receiving plate 15 except for an upper portion thereof is located under the sea surface 6, i.e., is sunk in the sea. The wave receiving plate 15 is arranged such that front and rear surfaces thereof are substantially parallel to the breakwater 2. The front surface of the wave receiving plate 15 receives waves (incident waves) coming from the offing, and the rear surface of the wave receiving plate 15 receives waves (reflected waves) reflected by the breakwater 2 and its vicinity. As above, the wave receiving plate 15 receives the force of the waves, and with this, the wave receiving member 13 swings about the rudder shaft 12. Further, the wave receiving member 13 swings to make the rudder shaft 12 turn about an axis of the rudder shaft 12.

As above, in each of the pair of wave receiving mechanisms 10L and 10R, the wave receiving member 13 receives the force of the waves, and with this, the rudder shaft 12 can be made to turn. Although details will be described later, each of the pair of wave receiving mechanisms 10L and 10R is configured such that longitudinal direction intermediate portions of the pair of arms 14 are bendable. When big waves come against the wave receiving mechanisms 10L and 10R, the wave receiving mechanisms 10L and 10R parry the force of the waves by bending the longitudinal direction intermediate portions. The axes of the rudder shafts 12 of the pair of wave receiving mechanisms 10L and 10R configured as above are located on substantially the same line, and the wave receiving mechanisms 10L and 10R are arranged at the floor panel 4 so as to be located away from each other in the left-right direction. A mount base 7 provided at the floor panel 4 is located between the pair of wave receiving mechanisms 10L and 10R arranged away from each other as above. The pump device 20 is provided at the mount base 7.

The pump device 20 is a ram cylinder pump and is connected to the above-described pair of rudder shafts 12. When the pair of rudder shafts 12 turn, the pump device 20 sucks and discharges an operating liquid (oil, water, or the like) in accordance with the turn of the rudder shafts 12. The pump device 20 having this function includes a pump shaft 21, a pair of cylinder mechanisms 22U and 22D, and a tiller 23. The pump shaft 21 is a substantially columnar member and extends in the left-right direction. The pump shaft 21 is arranged such that an axis thereof is coaxial with the axes of the pair of rudder shafts 12. The rudder shafts 12 of the pair of wave receiving mechanisms 10L and 10R are coupled to both end portions of the pump shaft 21 through flexible joints 16. Although the configuration of the flexible joint 16 will be described later in detail, the flexible joint 16 transfers turning force of the rudder shaft 12 to the pump shaft 21 while absorbing bending, twisting, and the like of the rudder shaft 12. With this, the turning force of the rudder shaft 12 can be surely transferred to the pump shaft 21. The pump shaft 21 configured as above penetrates the mount base 7. Both end portions of the pump shaft 21 are supported by the mount base 7 such that the pump shaft 21 is turnable.

The pair of cylinder mechanisms 22U and 22D are provided at the mount base 7. The pair of cylinder mechanisms 22U and 22D are respectively arranged above and under the pump shaft 21 so as to sandwich the pump shaft 21. The pair of cylinder mechanisms 22U and 22D arranged as above are so-called ram cylinder mechanisms and are the same in configuration as each other. To be specific, each of the pair of cylinder mechanisms 22U and 22D include a rod 25 and a pair of cylinders 26*a* and 26*b*. The operating liquid can be discharged from the pair of cylinders 26*a* and 26*b* by making the rod 25 reciprocate.

In a plan view, the rods 25 of the pair of cylinder mechanisms 22U and 22D configured as above are arranged so as to be perpendicular to and overlap the pump shaft 21. The rods 25 and the pump shaft 21 are coupled to each other by the tiller 23. The tiller 23 converts turning motion of the pump shaft 21 into linear reciprocating motion of the rod 25. Therefore, by turning the pump shaft 21, the operating liquid can be discharged from the pair of cylinder mechanisms 22U and 22D.

The pump device 20 is connected to a hydraulic motor through a hydraulic drive circuit (not shown). The discharged operating liquid is supplied to the hydraulic motor through the hydraulic drive circuit. The operating liquid discharged from the pump device 20 pulsates, and therefore, when the operating liquid is directly supplied to the hydraulic motor, the hydraulic motor cannot operate smoothly. On this account, in the hydraulic drive circuit, the pulsating operating liquid is leveled by an accumulator (not shown). Then, the operating liquid is supplied to the hydraulic motor to drive the hydraulic motor. The hydraulic drive circuit adjusts the flow rate and pressure of the operating liquid to be leveled, and with this, adjusts the output of the hydraulic motor. A power generator (not shown) is connected to an output shaft of the hydraulic motor whose output is adjusted as above. Therefore, the power generator can generate electric power by driving the hydraulic motor. The voltage, frequency, and phase of the electric power generated as above are adjusted by a power conditioner (not shown), and the adjusted electric power is transmitted to an electric power system. As above, the wave power generation system 1 can generate electric power by using the wave energy.

Wave Receiving Mechanism

As described above, when big waves come against the wave receiving plate 15, the wave power generation system 1 configured as above can parry the force of the waves by bending the longitudinal direction intermediate portions of the pair of arms 14. To be specific, the wave receiving mechanisms 10L and 10R are configured as bendable wave receiving mechanisms. Hereinafter, the configuration of the pair of arms 14 of each of the wave receiving mechanisms 10L and 10R having the above functions will be described in detail. It should be noted that the pair of arms 14 are the same in configuration as each other. Therefore, the following will describe only the configuration of one of the arms 14, and an explanation of the configuration of the other arm 14 is omitted.

Figure 4:
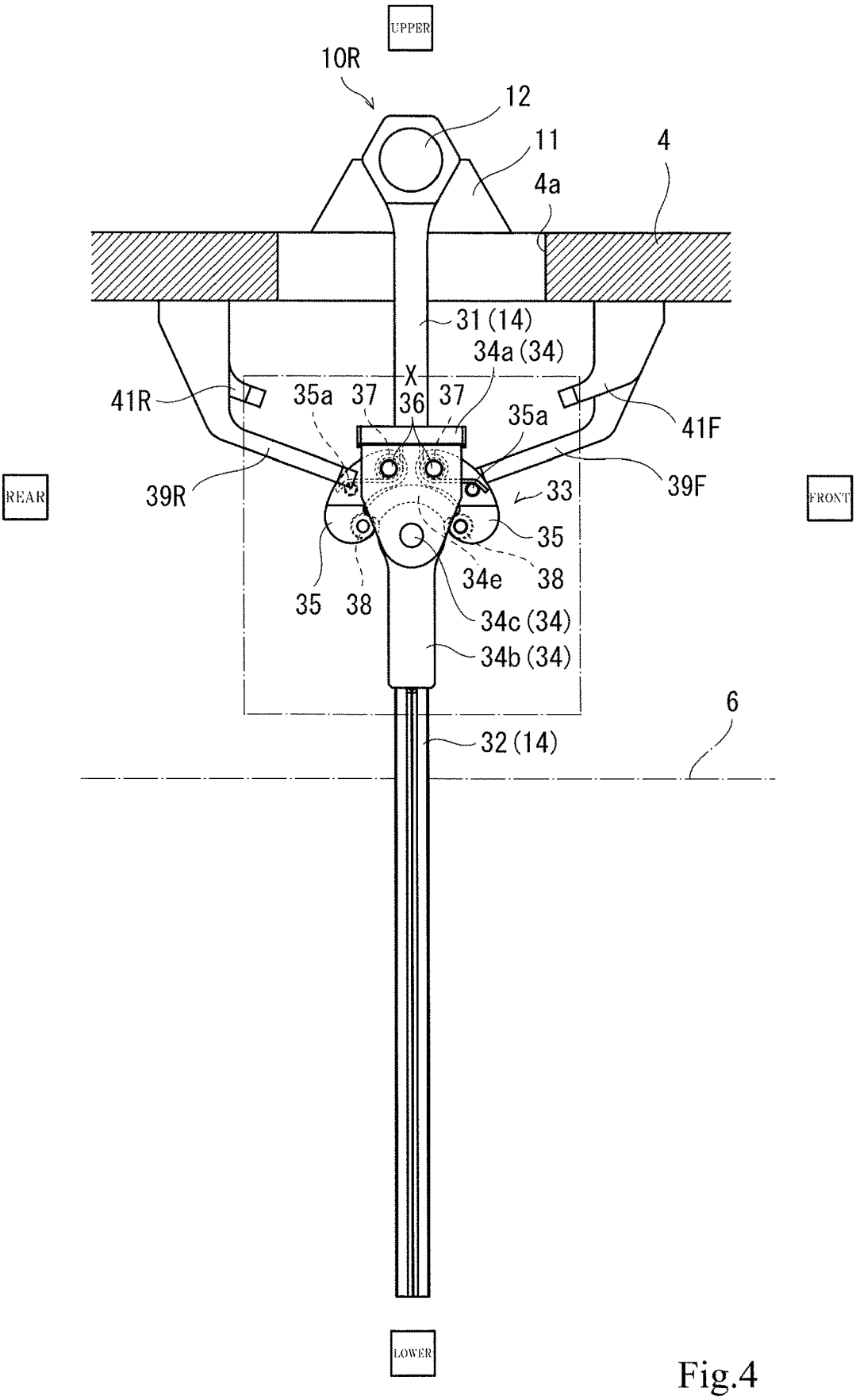
FIG. 4 is an enlarged side view showing a wave receiving mechanism of the wave power generation system of FIG. 3.

As shown in FIG. 4, the arm 14 includes an upper arm portion 31, a lower arm portion 32, and a ratchet 33. The upper arm portion 31 is a longitudinal member extending in the upper-lower direction. An upper end portion (i.e., one of longitudinal direction end portions) of the upper arm portion 31 is attached to the rudder shaft 12 so as not to be movable relative to the rudder shaft 12. The lower arm portion 32 is provided at a lower end portion of the upper arm portion 31 through the ratchet 33. The lower arm portion 32 is also a longitudinal member extending in the upper-lower direction. The wave receiving plate 15 is formed integrally with a lower end portion of the lower arm portion 32. The wave receiving plate 15 is provided at the lower end portions of the lower arm portions 32 of the pair of arms 14 so as to extend between the lower end portions of the lower arm portions 32 of the pair of arms 14. As described above, the wave receiving plate 15 receives the force of the incident waves and the force of the reflected waves. As described above, the ratchet 33 is interposed between the two arm portions 31 and 32 configured as above. These two arm portions 31 and 32 are coupled to each other by the ratchet 33.

Figure 5:
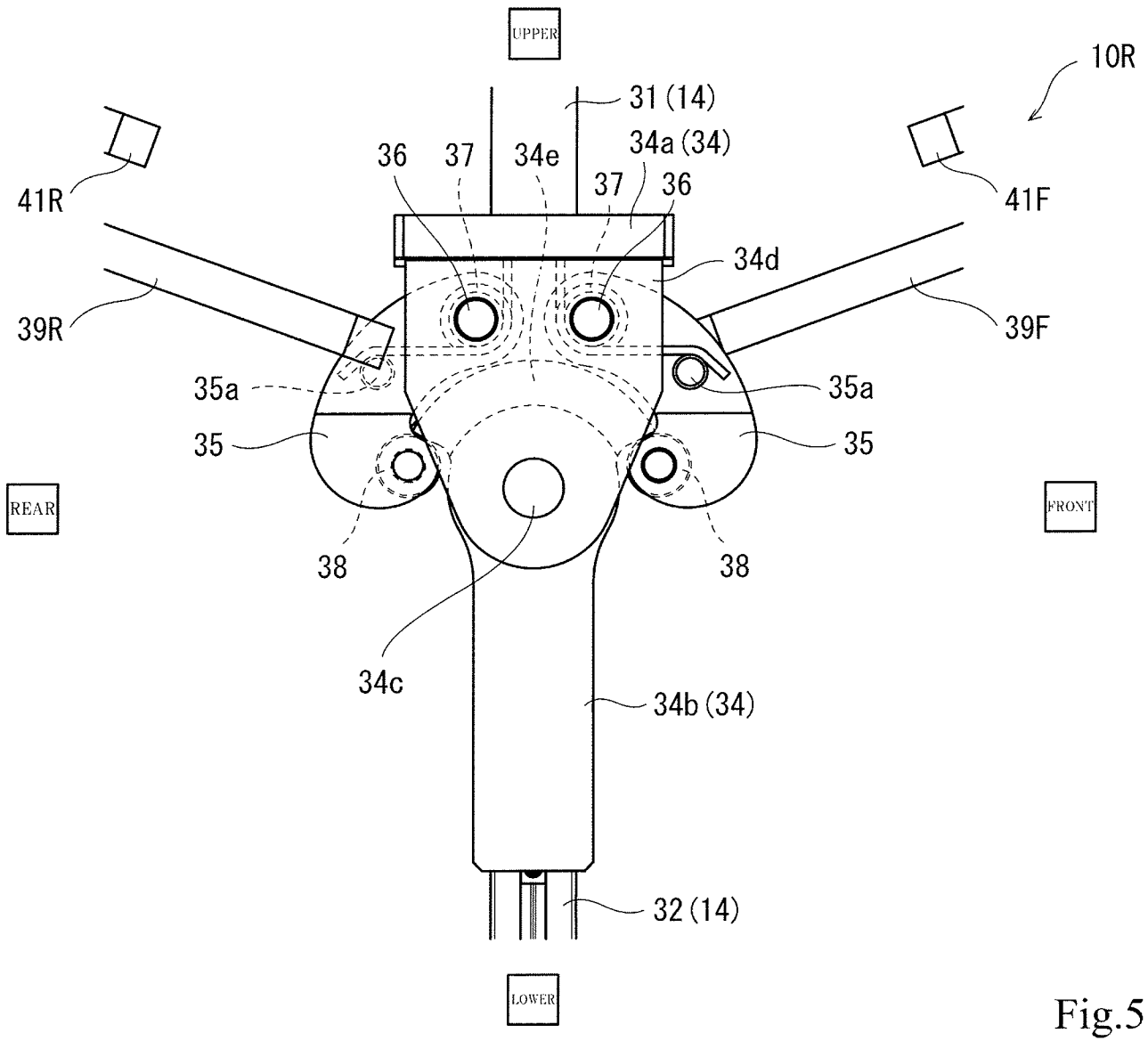
FIG. 5 is an enlarged side view showing a region X of the wave receiving mechanism of FIG. 4.
Figure 6:
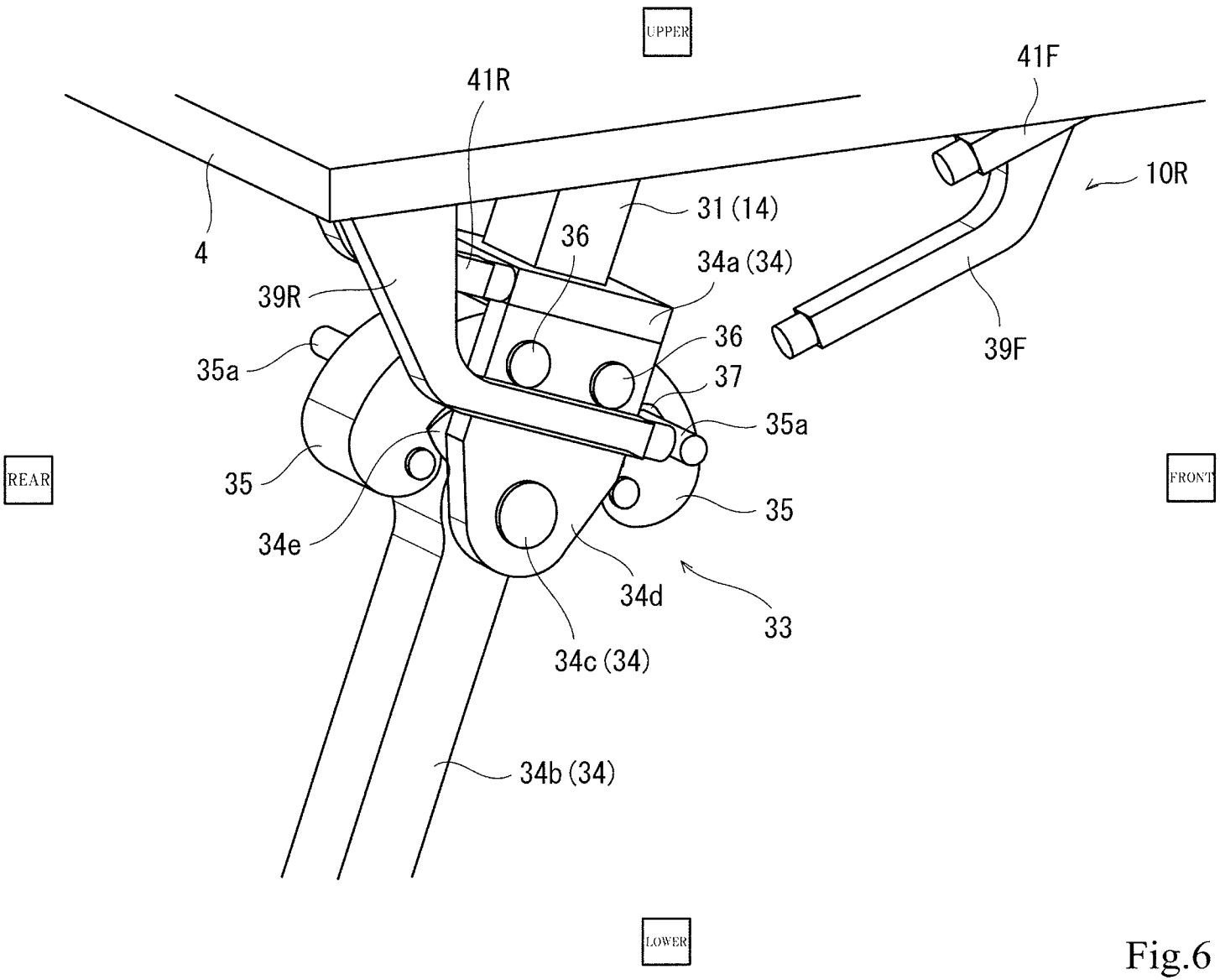
FIG. 6 is an enlarged perspective view showing the wave receiving mechanism of FIG. 4 when viewed obliquely from above.
Figure 7:
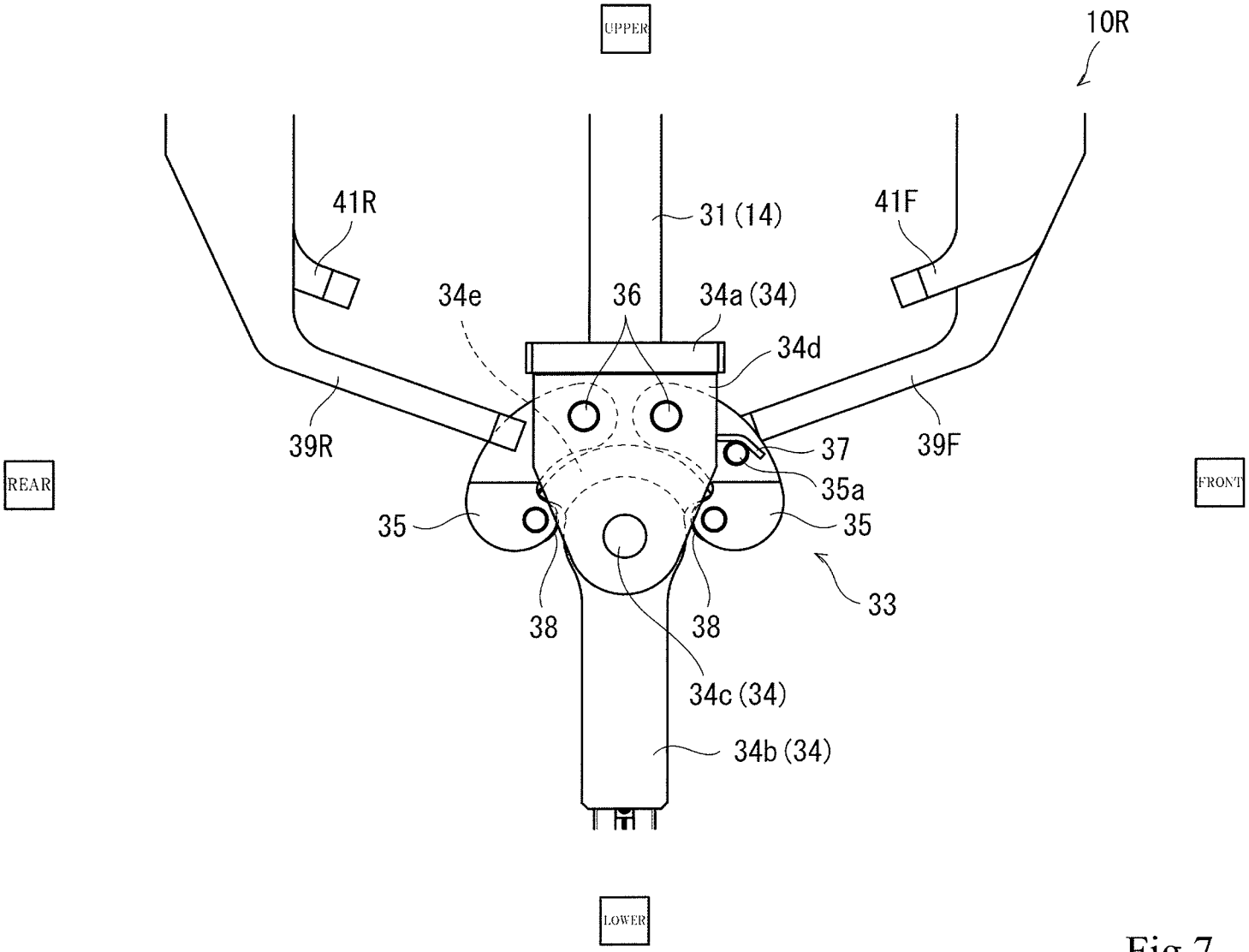
FIG. 7 is an enlarged side view showing that the wave receiving mechanism of FIG. 4 is located at a neutral position.
Figure 8:
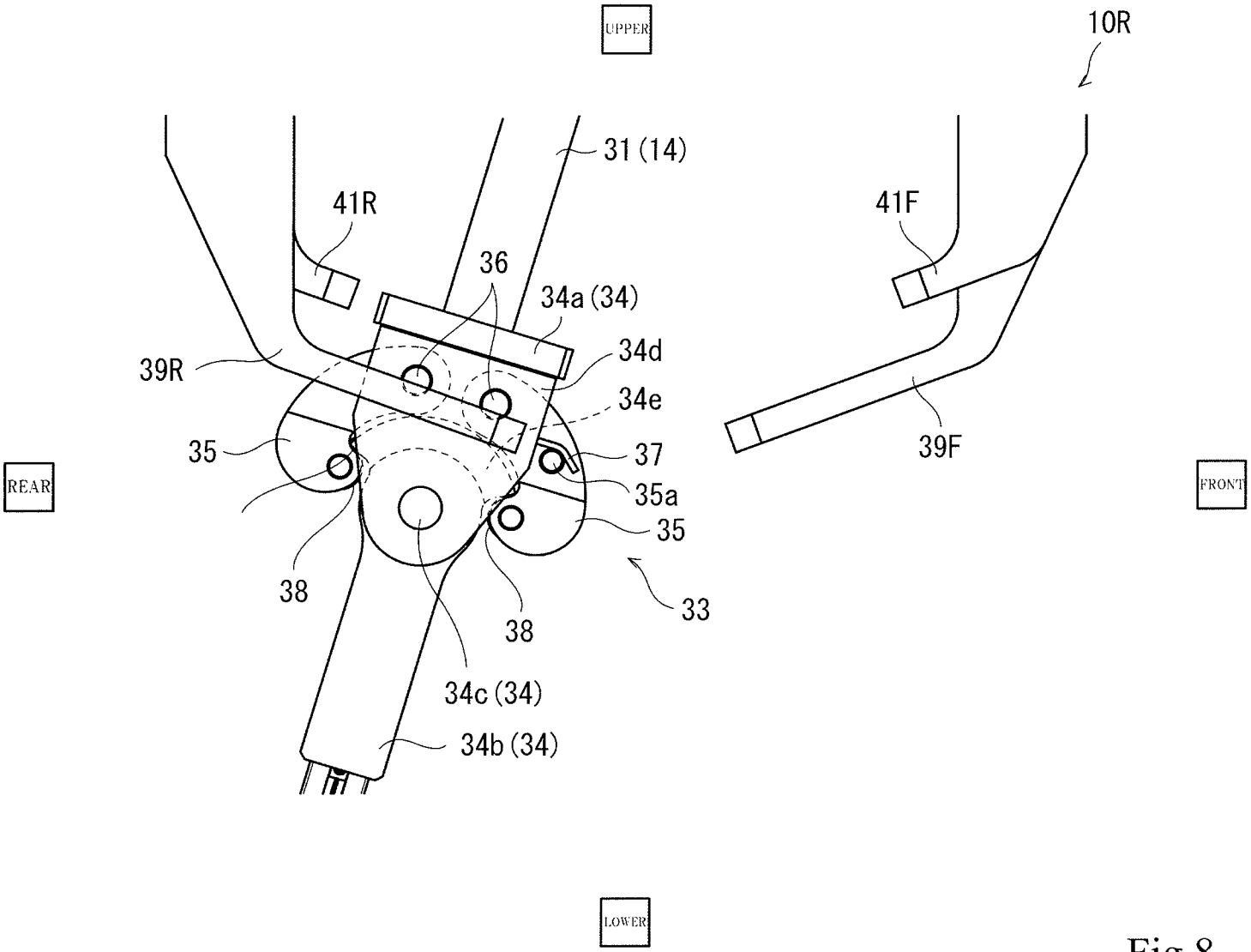
FIG. 8 is an enlarged side view showing that the wave receiving mechanism swings from the neutral position toward one side in a predetermined direction.

The ratchet 33 that is a bendable portion is configured as below such that: the upper arm portion 31 and the lower arm portion 32 are made to swing integrally; and when the wave receiving member 13 reaches a predetermined swing angle, bending of the lower arm portion 32 relative to the upper arm portion 31 is allowed. To be specific, as also shown in FIGS. 5 and 6, the ratchet 33 includes a hinge 34. The hinge 34 is a part which realizes the bending of the lower arm portion 32 relative to the upper arm portion 31. The hinge 34 includes an upper connecting body 34*a*, a lower connecting body 34*b*, and a hinge pin 34*c*.

As is clear from FIG. 6, the upper connecting body 34*a* is formed in a substantially inverted U shape when viewed from a rear side. The upper connecting body 34*a* includes a pair of side walls 34*d* arranged so as to be spaced apart from each other in the left-right direction. The lower connecting body 34*b* is inserted between the pair of side walls 34*d* of the upper connecting body 34*a*. The lower connecting body 34*b* is a longitudinal plate member extending in the upper-lower direction and having a width in the front-rear direction. An upper end portion of the lower connecting body 34*b* is inserted between the pair of side walls 34*d*. The hinge pin 34*c* is fittingly inserted into the pair of side walls 34*d* so as to also penetrate the upper end portion of the lower connecting body 34*b*. The lower connecting body 34*b* swings about the hinge pin 34*c* in the front-rear direction. A portion of the lower connecting body 34*b* which portion is located lower than an intermediate portion of the lower connecting body 34*b* projects downward from the pair of side walls 34*d*. The lower arm portion 32 is fixed to a lower end portion of the lower connecting body 34*b*. With this, the lower arm portion 32 moves integrally with the lower connecting body 34*b*.

According to the hinge 34 configured as above, the lower connecting body 34*b* can swing relative to the upper connecting body 34*a*, and therefore, the lower arm portion 32 can be bent relative to the upper arm portion 31. On the other hand, the ratchet 33 is configured as below such that the above bending does not occur when the waves are small. To be specific, the ratchet 33 includes a pair of hooks 35. The upper arm portion 31 and the lower arm portion 32 can move integrally by the pair of hooks 35.

To be specific, each of the pair of hooks 35 is formed in a substantially J shape in a side view. A tip end portion of each hook 35 is curved so as to be bent. Base end portions of the pair of hooks 35 each having the above shape are inserted between the pair of side walls 34*d* of the upper connecting body 34*a*. To be specific, the lower connecting body 34*b* is arranged between the pair of side walls 34*d* so as to form a space between the lower connecting body 34*b* and a ceiling surface of the upper connecting body 34*a*, and the base end portions of the pair of hooks 35 are inserted into the space from left and right sides of the space. Turning pins 36 are fittingly inserted into the base end portions of the pair of hooks 35 so as to be unrotatable relative to the base end portions of the pair of hooks 35. The turning pins 36 extend in the left-right direction. Both end portions of each turning pin 36 are supported by the pair of side walls 34*d* such that the turning pin 36 is turnable. As above, the pair of hooks 35 are provided at the upper connecting body 34*a* so as to be turnable about the corresponding turning pins 36. The pair of hooks 35 configured as above have a substantially inverted V shape in a side view. The pair of hooks 35 are arranged such that the curved tip end portion of one of the hooks 35 faces the other hook 35, i.e., curved tip end portions thereof are opposed to each other.

A circular-arc space is formed between the pair of hooks 35 arranged as above. The circular-arc space is formed along inner surfaces of the hooks 35. The tip end portions of the pair of hooks 35 are located at one side and the other side in a circumferential direction of the circular-arc space. The upper end portion of the lower connecting body 34*b* is arranged between the tip end portions of the pair of hooks 35. An engaged portion 34*e* located at the upper end portion of the lower connecting body 34*b* projects toward the circular-arc space. The engaged portion 34*e* is formed in a circular-arc shape so as to correspond to the shape of the circular-arc space. Therefore, the engaged portion 34*e* can be located in this circular space. The tip end portions of the pair of hooks 35 contact and are engaged with both circumferential direction end portions of the engaged portion 34*e* of the lower connecting body 34*b*. Thus, since the tip end portions of the pair of hooks 35 are engaged with the engaged portion 34*e*, the lower connecting body 34*b* is prevented from swinging. In order to maintain the engagement between the tip end portions of the pair of hooks 35 and the engaged portion 34*e*, biasing members 37 are provided at the pair of hooks 35 so as to correspond to the pair of hooks 35.

The biasing members 37 are so-called twisting coil springs, and coil portions of the biasing members 37 are externally attached to the corresponding turning pins 36 which are fittingly inserted into the corresponding hooks 35. Each biasing member 37 externally attached as above is arranged between the corresponding hook 35 and the side wall 34*d*. A locking pin 35*a* is formed at a first side surface of each hook 35. The locking pin 35*a* is formed so as to project from the first side surface of each hook 35. The pair of hooks 35 at which the locking pins 35*a* are formed as above are arranged such that the first side surfaces thereof face in directions opposite to each other. With this, the locking pins 35*a* project in directions different from each other along the left-right direction. The two biasing members 37 are externally attached to the corresponding turning pins 36 so as to be located at the corresponding first side surfaces of the pair of hooks 35 configured as above. One end portion of each biasing member 37 externally attached as above is locked to the corresponding locking pin 35*a* of the hook 35, and the other end portion of the biasing member 37 is locked to the ceiling surface of the upper connecting body 34*a*. The biasing member 37 arranged as above biases the corresponding hook 35 in such a direction around the turning pin 36 as to press the tip end portion of the hook 35 against the engaged portion 34*e*, i.e., in such a direction as to press the locking pin 35*a* downward. With this, the engagement between the pair of hooks 35 and the lower connecting body 34*b* is maintained, and bending of the lower connecting body 34*b* relative to the upper connecting body 43*a* is prevented, i.e., bending of the lower arm portion 32 relative to the upper arm portion 31 is prevented.

By making each hook 35 turn in a direction against the biasing force of the biasing member 37, the tip end portion of the hook 35 can be detached from the engaged portion 34*e*, i.e., the hook 35 and the engaged portion 34*e* can be disengaged from each other. By making one of the hooks 35 engage with the lower connecting body 34*b*, the lower connecting body 34*b* is prevented from swinging toward one side in the circumferential direction. Moreover, by making the other hook 35 engage with the lower connecting body 34*b*, the lower connecting body 34*b* is prevented from swinging toward the other side in the circumferential direction. Therefore, when the one hook 35 and the engaged portion 34*e* are disengaged from each other, the swinging of the lower connecting body 34*b* toward the one side in the circumferential direction is allowed. Moreover, when the other hook 35 and the engaged portion 34*e* are disengaged from each other, the swinging of the lower connecting body 34*b* toward the other side in the circumferential direction is allowed.

As above, the ratchet 33 can make the lower connecting body 34*b* move integrally with the upper connecting body 34*a* by making the pair of hooks 35 engage with the engaged portion 34*e*. Moreover, the ratchet 33 can allow the bending of the lower connecting body 34*b* relative to the upper connecting body 34*a* by turning the hooks 35 and thereby making the hooks 35 disengage from the engaged portion 34*e*. In order to smoothly disengage the pair of hooks 35 and the engaged portion 34*e* from each other, rollers 38 are provided at the tip end portions of the hooks 35, i.e., at the portions of the hooks 35 which portions are engaged with the engaged portion 34*e*.

Each of the rollers 38 is supported so as to be turnable about an axis extending in the left-right direction. The rollers 38 are arranged so as to contact the engaged portion 34*e* when the hooks 35 are engaged with the engaged portion 34*e*. Therefore, when the hooks 35 are made to turn so as to be disengaged from the engaged portion 34*e*, the rollers 38 roll on the surface of the engaged portion 34*e*. To be specific, the shape of the surface of the engaged portion 34*e* is a substantially circular-arc shape formed such that: the turning pin 36 is a rotational center; and a distance from the rotational center to a surface contacted by the roller 38 is a radius. With this, the rollers 38 can smoothly roll on the surface of the engaged portion 34*e*. Moreover, the shape of the surface of the engaged portion 34*e* is formed such that the radius thereof gradually increases from its tip end toward its base end in order to absorb a play generated at the surface of the engaged portion 34*e* by a radius error.

Since the rollers 38 are provided at the tip end portions of the hooks 35, the rollers 38 can roll on the surface of the engaged portion 34*e* at the time of the disengagement. Therefore, the engaged portion 34*e* is prevented from, for example, being caught by the tip end portion of the hook 35, i.e., the hooks 35 can be smoothly disengaged from the engaged portion 34*e* (i.e., can be prevented from being kept engaged with the engaged portion 34*e*). Moreover, since the rollers 38 can roll on the surface of the engaged portion 34*e* at the time of the engagement, the hooks 35 can be smoothly engaged with the engaged portion 34*e*. The wave receiving mechanism 10R capable of smoothly performing the engagement and the disengagement as above includes a pair of disengagement rods 39F and 39R for the disengagement.

Each of the pair of disengagement rods 39F and 39R is formed in a substantially L shape. The pair of disengagement rods 39F and 39R are suspended from the floor panel 4 so as to sandwich the opening 4*a* of the floor panel 4 and be located in front of and behind the opening 4*a* of the floor panel 4. To be specific, the pair of disengagement rods 39F and 39R extend downward from the floor panel 4, and intermediate portions of the pair of disengagement rods 39F and 39R are bent so as to approach each other. Tip end portions of the pair of disengagement rods 39F and 39R which portions are located at tip sides of the bent portions extend so as to be inclined downward and approach each other. The pair of disengagement rods 39F and 39R having such shapes are arranged so as to correspond to the locking pins 35*a* of the pair of hooks 35. To be specific, the disengagement rods 39F and 39R are arranged so as to deviate from each other in the left-right direction in accordance with the corresponding locking pins 35*a*. When the wave receiving member 13 largely swings toward the offing or the breakwater 2, the disengagement rod 39F or 39R arranged as above contacts the locking pin 35*a* of the corresponding hook 35.

For example, when the wave receiving member 13 largely swings toward the breakwater 2, the locking pin 35*a* of one of the hooks 35 contacts the rear-side disengagement rod 39R located closer to the breakwater 2 (see FIG. 5). When the wave receiving member 13 largely swings toward the offing, the locking pin 35*a* of the other hook 35 contacts the front-side disengagement rod 39F located closer to the offing. As above, the disengagement rod 39F or 39R is made to contact the locking pin 35*a* of the corresponding hook 35. With this, when the wave receiving member 13 further swings toward the breakwater 2 or the offing, the hook 35 is pushed in a direction opposite to a swinging direction of the wave receiving member 13. Therefore, the corresponding hook 35 turns in a direction away from the engaged portion 34*e*, and thus, the hook 35 and the engaged portion 34*e* are disengaged from each other. As above, when the disengagement rod 39F or 39R contacts the locking pin 35*a*, and the wave receiving member 13 further swings, the hook 35 turns in a direction against the biasing force, and therefore, the hook 35 and the engaged portion 34*e* can be disengaged from each other.

More specifically, when the wave receiving member 13 swings toward the breakwater 2 or the offing at a first predetermined angle (For example, the first predetermined angle is set in a range of 30° or more and 34° or less. In the present embodiment, the first predetermined angle is 30°.), the disengagement rod 39F or 39R disengages the hook 35 and the engaged portion 34*e* from each other. To be specific, when the wave receiving member 13 swings toward the breakwater 2 or the offing, the disengagement rod 39F or 39R contacts the corresponding locking pin 35*a*. When the wave receiving member 13 further swings, the disengagement rod 39F or 39R makes the hook 35 turn. When the wave receiving member 13 swings at the first predetermined angle, the disengagement rod 39F or 39R disengages the hook 35 and the engaged portion 34*e* from each other. In the present embodiment, the first predetermined angle toward the breakwater 2 and the first predetermined angle toward the offing are set to be equal to each other, but do not have to be equal to each other and may be different from each other. The wave receiving mechanism 10R configured as above includes a pair of stoppers 41F and 41R in order to prevent the wave receiving member 13, i.e., the upper arm portion 31 from swinging beyond a second predetermined angle.

As with the pair of disengagement rods 39F and 39R, each of the pair of stoppers 41F and 41R is formed in a substantially L shape, and the pair of stoppers 41F and 41R are suspended from the floor panel 4 so as to sandwich the opening 4*a* and be located in front of and behind the opening 4*a*. To be specific, the pair of stoppers 41F and 41R extend downward from the floor panel 4, and intermediate portions of the pair of stoppers 41F and 41R are bent so as to approach each other. Tip end portions of the pair of stoppers 41F and 41R which portions are located at tip sides of the bent portions extend so as to be inclined downward and approach each other. The pair of stoppers 41F and 41R having such shapes are arranged so as to correspond to the upper connecting body 34*a*. When the wave receiving member 13 largely swings toward the offing or the breakwater 2, the disengagement rod 39F or 39R contacts the upper connecting body 34*a*.

For example, when the wave receiving member 13 largely swings toward the breakwater 2, the rear-side stopper 41R located closer to the breakwater 2 contacts the upper connecting body 34*a* (see FIG. 5). When the wave receiving member 13 largely swings toward the offing, the front-side stopper 41F located closer to the offing contacts the upper connecting body 34*a*. Since the stopper 41F or 41R contacts the upper connecting body 34*a*, the movement of the upper connecting body 34*a* is stopped, and the swinging of the upper arm portion 31 is restricted. When the wave receiving member 13 swings toward the breakwater 2 or the offing at the second predetermined angle (For example, the second predetermined angle is set in a range of 30° or more and 34° or less. In the present embodiment, the second predetermined angle is 30°.), the stopper 41L or 41R having such function contacts the upper connecting body 34*a* to restrict the swinging of the upper arm portion 31.

The operation of the wave receiving mechanism 10R configured as above will be described with reference to FIGS. 7 to 11. In the wave receiving mechanism 10R, the wave receiving plate 15 mainly receives the force of the waves and swings toward the breakwater 2 or the offing by the waves. To be specific, the wave receiving member 13 swings toward the breakwater 2 by the force of input waves coming from the offing and also swings toward the offing by the force of reflected waves reflected by the breakwater 2. Except for a case of receiving the force of large waves generated at the time of a typhoon or the like, the wave receiving member 13 (i.e., the upper arm portion 31) basically swings toward the breakwater 2 within an angular range of the first predetermined angle or less or swings toward the offing within an angular range of the first predetermined angle or less (see FIGS. 7 and 8, for example). In this case, since the disengagement rods 39F and 39R do not contact the locking pins 35*a* of the pair of hooks 35, the pair of hooks 35 are pressed against and engaged with the engaged portion 34*e* by the biasing members 37, and the upper arm portion 31 and the lower arm portion 32 integrally move by the ratchet 33. With this, the wave receiving member 13 can apply torque, corresponding to the force of the input waves and the force of the reflected waves, through the rudder shaft 12 to the pump device 20. With this, the power generator can generate electric power corresponding to the torque.

Figure 9:
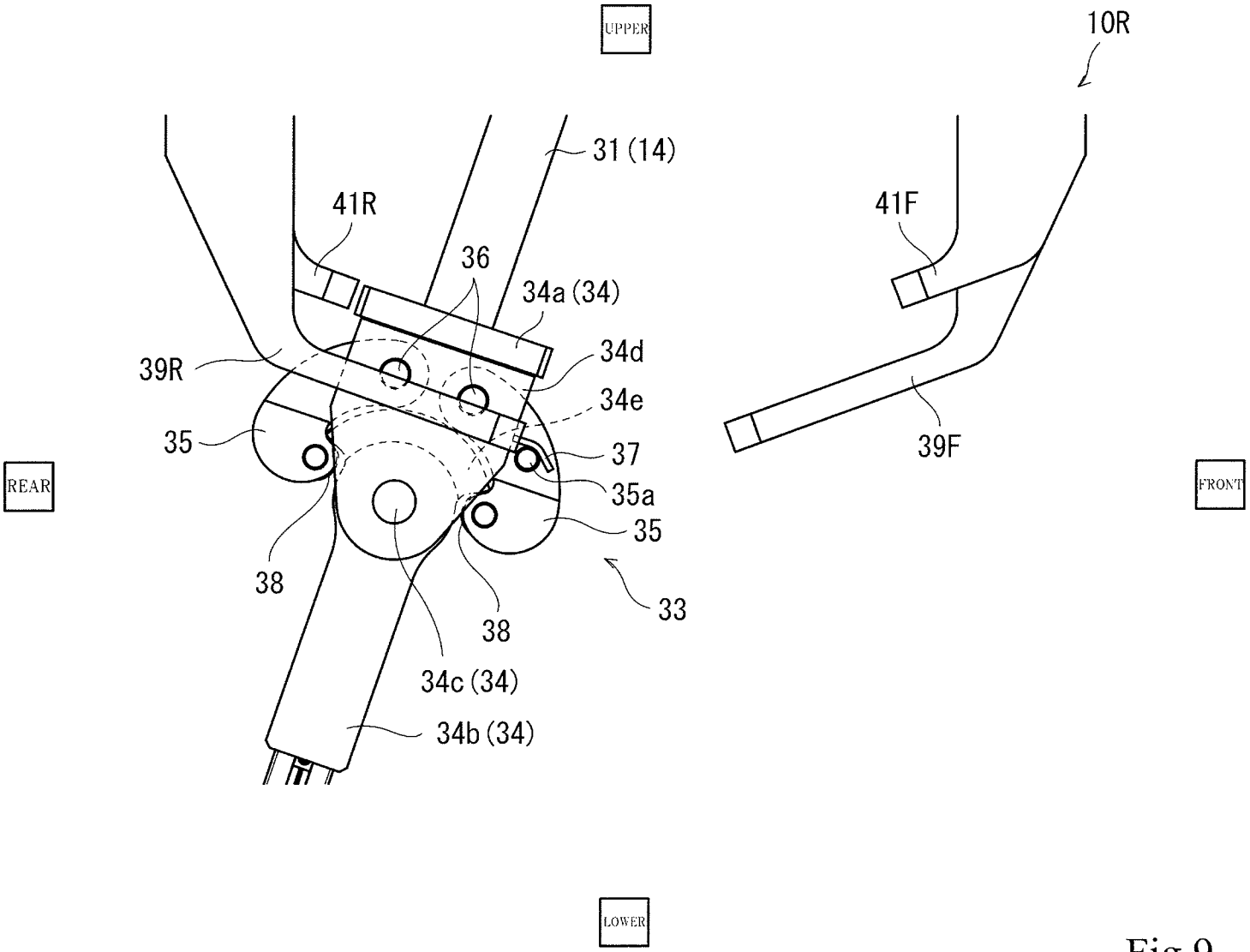
FIG. 9 is an enlarged side view showing that a locking pin of the wave receiving mechanism that swings is in contact with a disengagement rod.
Figure 10:
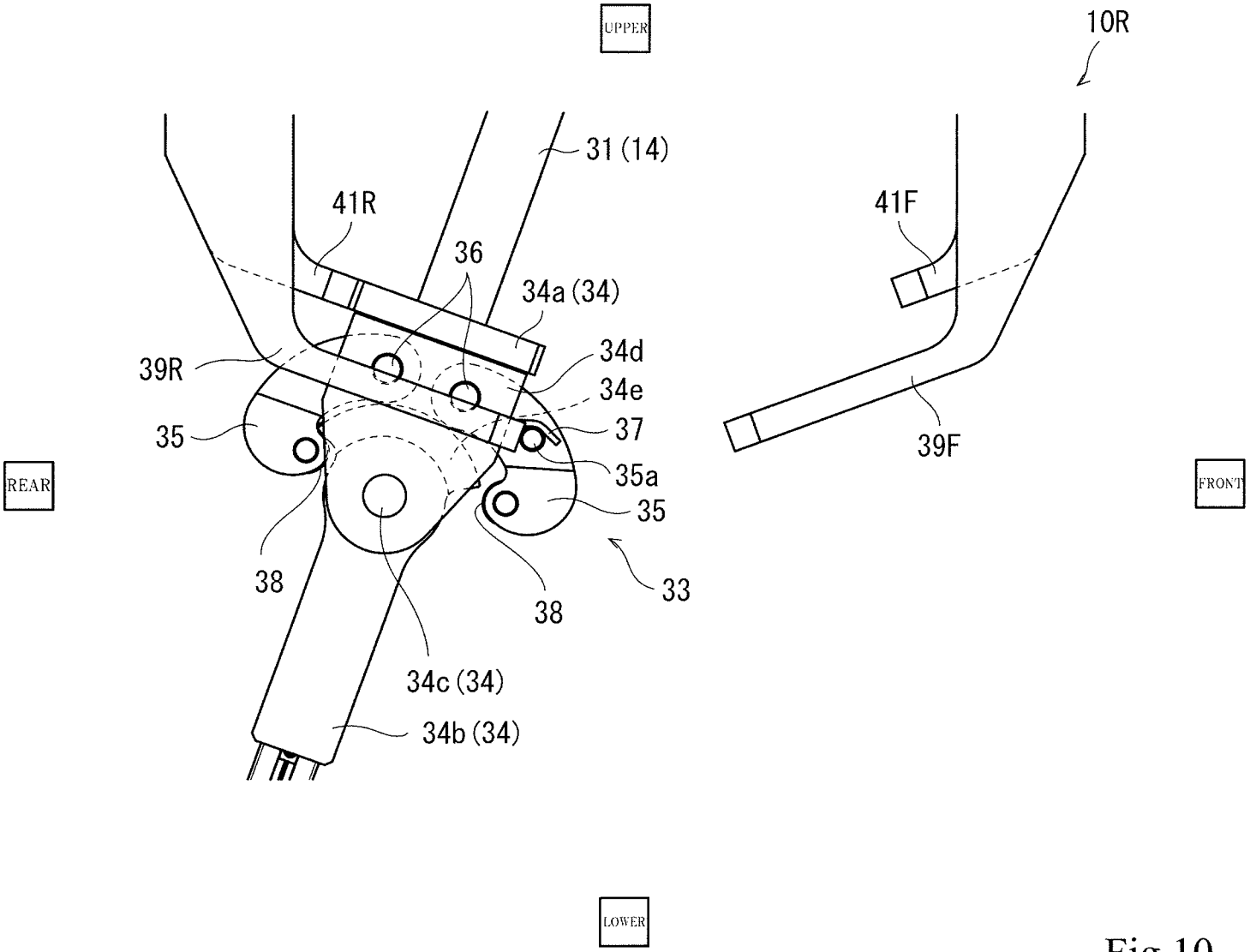
FIG. 10 is an enlarged side view showing that a hook of the wave receiving mechanism is pushed and opened by the disengagement rod.
Figure 11:
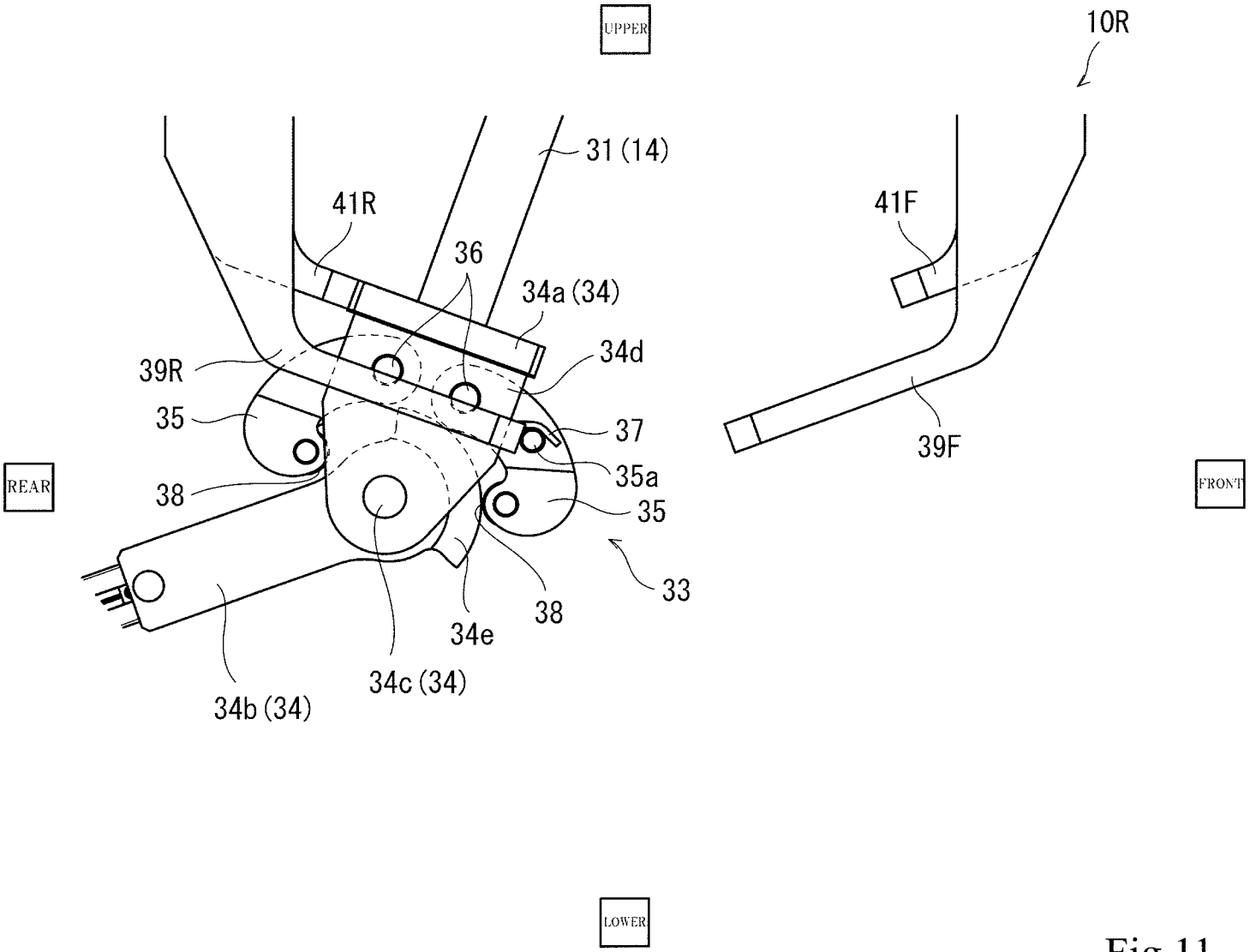
FIG. 11 is an enlarged side view showing that a lower arm portion is bent with respect to an upper arm portion.

On the other hand, when large waves are generated at the time of a typhoon or the like, the upper arm portion 31 of the wave receiving member 13 may swing by the large waves toward the breakwater 2 or the offing beyond the first predetermined angle (see FIGS. 9 to 11, for example). In this case, the wave receiving member 13 operates as below. To be specific, when the upper arm portion 31 of the wave receiving member 13 swings, one of the locking pins 35*a* finally contacts the disengagement rod 39F or 39R. For example, as shown in FIG. 9, when the upper arm portion 31 swings toward the breakwater 2, the locking pin 35*a* of one of the hooks 35 contacts the disengagement rod 39R. When the upper arm portion 31 further swings toward the breakwater 2 in this state, the one of the hooks 35 is pushed toward the offing. With this, the corresponding roller 38 rolls on the surface of the engaged portion 34*e*. After that, when a swing angle of the upper arm portion 31 toward the breakwater 2 becomes the first predetermined angle, the tip end portion of the hook 35 is detached from the engaged portion 34*e*, and thus, the hook 35 and the engaged portion 34*e* are disengaged from each other (see FIG. 10).

In this disengaged state, the lower connecting body 34*b* is allowed to swing toward one side in the circumferential direction. Therefore, when the wave receiving plate 15 further receives the force of the incident waves, the lower connecting body 34*b* turns about the hinge pin 34*c*, and the lower arm portion 32 swings so as to be bent toward the breakwater 2 relative to the upper arm portion 31 (see FIG. 11). As above, when the upper arm portion 31 swings at the first predetermined angle, the lower arm portion 32 is bent relative to the upper arm portion 31. With this, even when the wave receiving member 13 is pushed by large waves, the wave receiving member 13 can parry the force of the waves. Therefore, it is possible to manufacture the wave receiving mechanisms 10L and 10R which can prevent a case where the wave receiving member 13 is damaged when large waves are generated, and can endure the large waves without increasing the sizes thereof. Moreover, since the wave receiving member 13 parries the force of the large waves, excessive torque can be prevented from being transmitted through the upper arm portion 31 and the rudder shaft 12 to the pump device 20. With this, it is possible to prevent a case where the pump device 20 is damaged when large waves are generated at the time of a typhoon or the like.

The wave receiving member 13 parries the force of the incident waves by bending the lower arm portion 32 but receives part of the force of the incident waves, and the received force is transmitted through the ratchet 33 to the upper arm portion 31. With this, the upper arm portion 31 continuously swings even after the disengagement although the swinging is gentler than the swinging before the disengagement, and the upper arm portion 31 swings beyond the first predetermined angle, i.e., at the second predetermined angle. Then, when the upper arm portion 31 swings at the second predetermined angle, the upper connecting body 34*a* contacts the stopper 41R, and this restricts the swinging of the upper arm portion 31. By restricting the swinging of the upper arm portion 31, the turning of the rudder shaft 12 is also restricted. With this, the rod 25 connected to the rudder shaft 12 through the pump shaft 21 and the tiller 23 can be prevented from stroking by a predetermined amount or more, and therefore, it is possible to prevent a case where the pump device 20 is damaged since the rod 25 strokes by the predetermined amount or more.

As above, when large input waves come, the wave receiving member 13 can parry the force of the input waves by bending the lower arm portion 32. Further, when the wave receiving member 13 that has swung toward the breakwater 2 swings toward the offing after the disengagement, the engagement is performed again through a procedure opposite to the above-described procedure. To be specific, when the upper arm portion 31 returns, the hook 35 and the engaged portion 34*e* are again engaged with each other to the first predetermined angle, and the upper arm portion 31 swings toward the offing. When the reflected waves are also large, as with when the incident waves are large, the lower arm portion 32 is bent toward the offing, and thus, the force of the reflected waves can be parried.

To be specific, when the upper arm portion 31 largely swings by the reflected waves, the locking pin 35*a* of the other hook 35 contacts the disengagement rod 39F. When the upper arm portion 31 further swings, the other hook 35 is pushed toward the breakwater 2 relative to the lower connecting body 34*b*. After that, when the upper arm portion 31 swings toward the offing at the first predetermined angle or more, the tip end portion of the other hook 35 is detached from the engaged portion 34*e*, and thus, the hook 35 and the engaged portion 34*e* are disengaged from each other. When the wave receiving plate 15 continuously receives the force of the reflected waves thereafter, the lower arm portion 32 swings so as to be bent relative to the upper arm portion 31 toward the offing in order to parry the force of the reflected waves. After that, the upper arm portion 31 continuously swings beyond the first predetermined angle, i.e., at the second predetermined angle. When the upper arm portion 31 swings at the second predetermined angle, the upper connecting body 34*a* contacts the stopper 41L, and this restricts the swinging of the upper arm portion 31. As above, when the wave receiving member 13 swings toward the offing, as with when the wave receiving member 13 swings toward the breakwater, the wave receiving member 13 parries the force of the waves if the wave receiving member 13 swings beyond the first predetermined angle. When the wave receiving member 13 swings at the second predetermined angle, the movement of the upper arm portion 31 is restricted. Thus, the same operational advantages as above are obtained.

According to the wave receiving mechanisms 10L and 10R configured as above, the bending of the lower arm portion 32 relative to the upper arm portion 31 can be allowed by a simple operation of just disengaging the hook 35 and the lower connecting body 34*b* from each other. With this, an increase in the number of parts of the wave receiving mechanisms 10L and 10R and an increase in manufacturing cost can be suppressed. Moreover, when the upper arm portion 31 swings at the first predetermined angle with the disengagement rod 39F or 39R contacting the locking pin 35*a*, the hook 35 and the lower connecting body 34*b* are automatically disengaged from each other. Therefore, the disengagement rods 39F and 39R and the ratchet 33 can be easily configured.

Flexible Joint

Since the wave power generation system 1 configured as above is a steel marine jacket structure, the post piles 3 swing by influences of the waves. The post piles 3 respectively swing, i.e., behave differently, and as a result, the entire structure of the wave power generation system 1 is distorted. For example, the pair of support bases 11 deviate from each other in the front-rear direction by this distortion. In this case, the rudder shaft 12 supported by the pair of support bases 11 is bent so as to curve forward or rearward. The rudder shaft 12 adopted in the wave power generation system 1 has a length of about several meters to ten and several meters. Even when one of the support bases 11 deviates from the other support base 11 only by several millimeters to several tens of millimeters, excessive load is generated. Such load acts on a coupling portion by which the rudder shaft 12 and the pump shaft 21 are coupled to each other. Therefore, when the rudder shaft 12 and the pump shaft 21 are fixedly coupled to each other, the coupling portion may be damaged by the load.

Moreover, according to the wave power generation system 1, the input waves and the reflected waves do not necessarily contact the wave receiving plates 15 of the two wave receiving mechanisms 10L and 10R in a direction perpendicular perpendicular to the wave receiving plates 15. To be specific, in some cases, the waves contact the wave receiving plates 15 at an angle, i.e., obliquely contact the wave receiving plates 15. When the waves obliquely contact the wave receiving plates 15, a phase difference is generated between the turning operations of the two rudder shafts 12. The pump shaft 21 including both end portions to which the two rudder shafts 12 are coupled is twisted. No big problems occur when the waves are small. However, as the waves become large, the pump shaft 21 is twisted largely. Therefore, when the large waves are generated at the time of a typhoon or the like, the pump shaft 21 may be damaged.

On this account, in the wave power generation system 1, to avoid the above-described case, as shown in FIG. 1, the rudder shaft 12 and the pump shaft 21 are coupled to each other by the flexible joint 16. As described above, the flexible joint 16 transmits the turning force of the rudder shaft 12 to the pump shaft 21 while allowing the bending and twisting of the rudder shaft 12 relative to the pump shaft 21. Hereinafter, the configuration of the flexible joint 16 having such function will be described in detail.

Figure 12:
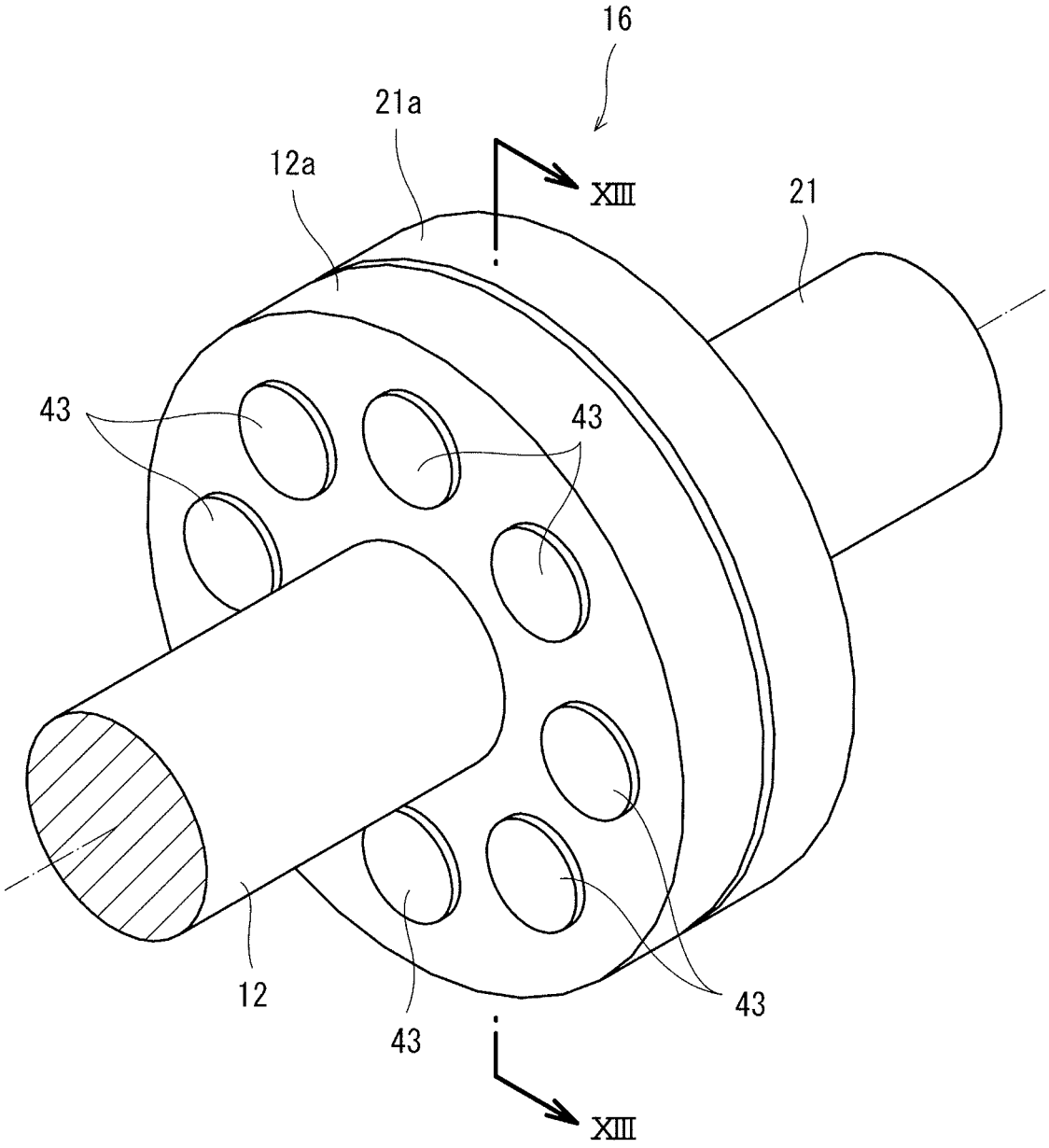
FIG. 12 is a perspective view showing a flexible joint and its vicinity in the wave power generation system of FIG. 2.
Figure 13:
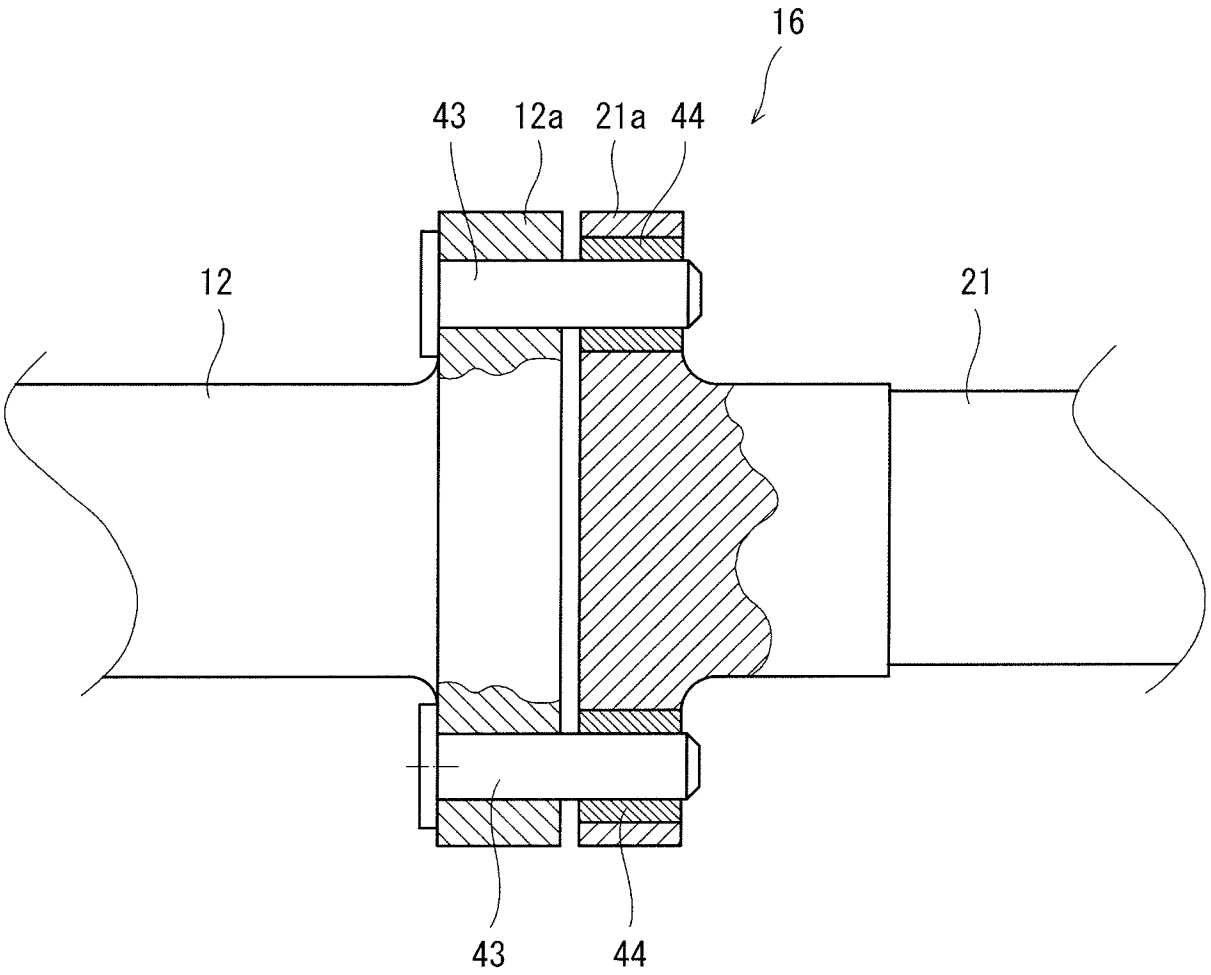
FIG. 13 is a sectional view taken along line XIII-XIII of FIG. 12 and showing the flexible joint.

In each of the wave receiving mechanisms 10L and 10R, the other end portions of the rudder shafts 12 are opposed to both end portions of the pump shaft 21, and flanges 12*a* and 21*a* constituting the flexible joints 16 are formed at these end portions. To be specific, as shown in FIG. 12, a rudder flange 12*a* having a substantially annular shape is formed at the other end portion of the rudder shaft 12. The rudder flange 12*a* is formed at the other end portion of the rudder shaft 12 so as to project outward in a radial direction over the entire periphery in the circumferential direction. As shown in FIG. 13, a plurality of pin holes 12*b* (in the present embodiment, eight pin holes 12*b*) are formed on the rudder flange 12*a* at regular intervals in the circumferential direction. The plurality of pin holes 12*b* penetrate the rudder flange 12*a* in parallel with an axis of the rudder shaft 12. In order to couple the flanges 12*a* and 21*a* to each other, torque pins 43 are fittingly inserted into the plurality of pin holes 12*b*. The pump flange 21*a* of the pump shaft 21 is formed as below so as to be able to be coupled to the rudder flange 12*a*.

To be specific, the pump flanges 21*a* are formed at both end portions of the pump shaft 21 so as to face the rudder flanges 12*a* as described above. The pump flanges 21*a* are formed at both end portions of the pump shaft 21 so as to project outward in the radial direction over the entire periphery in the circumferential direction. The pump flange 21*a* formed as above has a substantially annular shape as with the rudder flange 12*a*, and an outer diameter of the pump flange 21*a* is equal to an outer diameter of the rudder flange 12*a*. The pump flange 21*a* having such shape faces the rudder flange 12*a* so as to overlap the rudder flange 12*a* when viewed from an axial direction.

A plurality of bushing holes 21*b* (in the present embodiment, eight bushing holes 21*b*) are formed on the pump flange 21*a* at regular intervals in the circumferential direction. More specifically, the plurality of bushing holes 21*b* are formed so as to correspond to the plurality of pin holes 12*b* of the rudder flange 12*a*. The corresponding holes 12*b* and 21*b* communicate with each other with the two flanges 12*a* and 21*a* facing each other. The bushing holes 21*b* formed as above are larger in diameter than the pin holes 12*b*, and damper bushings 44 are fittingly inserted into the bushing holes 21*b*.

Each damper bushing 44 is formed in a substantially cylindrical shape, and the torque pin 43 can be fittingly inserted into the damper bushing 44. For example, the damper bushing 44 is configured as below. To be specific, the damper bushing 44 includes metal inner and outer tubes which are different in outer diameter from each other. The damper bushing 44 is configured by: inserting the inner tube into the outer tube; and subjecting the inner and outer tubes to vulcanized adhesion using synthetic rubber. The outer tube and the inner tube are arranged away from each other such that the synthetic rubber interposed therebetween has a predetermined thickness. To be specific, in the damper bushing 44, the inner tube is allowed to be displaced relative to the outer tube in a direction perpendicular to the axis by elastic deformation of the synthetic rubber. As described above, the damper bushings 44 configured as above are fittingly inserted into the eight bushing holes 21*b*. An inner diameter of the damper bushing 44 (i.e., an inner diameter of the inner tube) substantially coincides with an outer diameter of the torque pin 43, and the torque pin 43 can be fittingly inserted into the damper bushing 44.

According to the flexible joint 16 configured as above, the flanges 12*a* and 21*a* face each other, and the corresponding holes 12*b* and 21*b* also face each other. The torque pins 43 are fittingly inserted into the pin holes 12*b*. Head portions formed at base end portions of the torque pins 43 are fastened to and fixed to the rudder flange 21*a* by, for example, bolts (not shown). The torque pin 43 fixed as above is longer than the pin hole 12*b*, and a tip end portion of the torque pin 43 projects from the pin hole 12*b*. The tip end portion of the torque pin 43 extends to the damper bushing 44 and is fittingly inserted into the damper bushing 44. As above, the torque pins 43 are fittingly inserted into the holes 12*b* and 21*b* and arranged at the flanges 12*a* and 21*a* at regular intervals in the circumferential direction. With this, the flanges 12*a* and 21*a* are coupled to each other so as not to be movable relative to each other (i.e., the shafts 12 and 21 are coupled to each other so as not to be movable relative to each other). With this, the torque of the rudder shaft 12 is surely transmitted to the pump shaft 21.

As described above, the two shafts 12 and 21 are coupled to each other by the eight torque pins 43 arranged at regular intervals in the circumferential direction, and all of the eight torque pins 43 are fittingly inserted into the pump flange 21*a* through the damper bushings 44. Therefore, all of the torque pins 43 are displaceable relative to the pump flange 21*a* in any directions perpendicular to the axis of the pump shaft 21, and such displacement can be absorbed by the damper bushings 44. As described above, the rudder shaft 12 bends in some cases. In such cases, the bending of the rudder shaft 12 can be absorbed by the damper bushings 44. To be specific, bending load generated by the bending can be prevented from being transmitted to the pump shaft 21, and the pump device 20 can be prevented from being damaged by the bending load.

The same is true when the rudder shaft 12 twists. In such a case, even when the torque pins 43 are displaced in the circumferential direction by the twisting of the rudder shaft 12, such displacement is absorbed by the damper bushings 44. Therefore, even when the rudder shaft 12 is twisted, twisting torque can be prevented from being transmitted to the pump shaft 21, and the pump device 20 can be prevented from being damaged by the twisting of the pump shaft 21.

As above, in the wave power generation system 1, the flexible joint 16 is interposed between the shafts 12 and 21. With this, even when the rudder shaft 12 is bent or twisted, such bending or twisting can be absorbed by the flexible joint 16. Therefore, even when the rudder shaft 12 is bent or twisted, the rudder shaft 12 and the pump shaft 21 can be prevented from being damaged.

Other Embodiments

In the wave power generation system 1 according to the present embodiment, the pair of cylinder mechanisms 22U and 22D are arranged so as to be spaced apart from each other in the upper-lower direction. However, the present embodiment is not necessarily limited to this, and the pair of cylinder mechanisms 22U and 22D may be arranged so as to be spaced apart from each other in the left-right direction. The pump device 20 does not necessarily have to include the two cylinder mechanisms 22U and 22D and may include one cylinder mechanism.

In the wave power generation system 1, the wave receiving mechanisms 10R and 10L are arranged at left and right sides of the pump device 20. However, the wave receiving mechanisms 10R and 10L do not necessarily have to be arranged at the left and right sides of the pump device 20, and the wave receiving mechanism may be arranged at only one of the left and right sides of the pump device 20. The pump device 20 may be arranged between the pair of arms 14. The pump device 20 is not necessarily limited to a ram cylinder pump and is only required to be configured to be able to discharge the operating liquid by the swinging of the wave receiving member 13.

Moreover, in the wave power generation system 1, the rudder shafts 12 and the pump shaft 21 are configured as separate shafts but may be configured as a single shaft. The wave receiving member 13 is attached to the rudder shaft 12 so as to hang down from the rudder shaft 12, but may be configured as below. To be specific, the rudder shaft 12 may stand on a seabed, and the wave receiving member 13 may be provided at the rudder shaft 12 so as to extend in a direction (i.e., a radial direction) perpendicular to the rudder shaft 12 and so as not to be movable relative to the rudder shaft 12. Furthermore, the wave receiving member 13 includes the pair of arms 14 between which the wave receiving plate 15 extends. However, the number of arms 14 may be one.

In the wave receiving mechanisms 10L and 10R, the wave receiving member 13 is configured to be bent at its intermediate portion by the ratchet 33. However, such bendable configuration is not limited to the ratchet 33. Moreover, components used for the disengagement in the ratchet 33 are not necessarily limited to the disengagement rods 39F and 39R, and the disengagement may be performed by using an electric actuator or the like based on a disengagement command. In the wave receiving mechanisms 10L and 10R, the swinging of the wave receiving member 13 is restricted by the stopper members but does not necessarily have to be restricted.

Furthermore, in the wave receiving mechanisms 10L and 10R, the rollers 38 are provided at the tip end portions of the pair of hooks 35. However, the rollers 38 do not necessarily have to be provided at the tip end portions of the pair of hooks 35. For example, the rollers 38 may be provided at the engaged portion 34*e* of the lower connecting body 34*b*. Even in this case, the same operational advantages as when the rollers 38 are provided at the tip end portions of the pair of hooks 35 can be obtained. In the wave receiving mechanisms 10L and 10R, the rollers 38 do not necessarily have to be provided. For example, in order to make the engaged portion 34*e* become slippery, the engaged portion 34*e* may be subjected to coating to have a sliding surface, and thus, the engagement and the disengagement may be facilitated.

Moreover, in the wave power generation system 1, the rudder shaft 12 and the pump shaft 21 are coupled to each other by the flexible joint 16. However, the configuration of the flexible joint 16 is not limited to the above configuration. The flexible joint 16 is only required to be a joint, such as a universal joint or a fluid coupling, capable absorbing at least one of bending and twisting.

REFERENCE SIGNS LIST

1 wave power generation system
10L, 10R wave receiving mechanism
12 rudder shaft
13 wave receiving member
14 arm
15 wave receiving plate
16 flexible joint
20 pump device (hydraulic pump)
21 pump shaft
25 rod
31 upper arm portion (first arm portion)
32 lower arm portion (second arm portion)
33 ratchet (bendable portion)
34*e* engaged portion
35 hook
35*a* locking pin
38 roller (sliding surface)
39F front-side disengagement rod
39R rear-side disengagement rod
41F front-side stopper
41R rear-side stopper

The invention claimed is:

1. A wave receiving mechanism comprising:

a shaft connected to a hydraulic pump and supported so as to be turnable, the shaft being configured to drive the hydraulic pump by turning toward a first side or second side in a circumferential direction; and a wave receiving member including an arm and a wave receiving plate, the arm being attached to the shaft so as to be unrotatable relative to the shaft, the wave receiving plate being provided at the arm so as to receive force of waves, the wave receiving member being configured to swing about the shaft by receiving the force of the waves and make the shaft turn by the swinging, wherein:

the arm includes a first arm portion, a second arm portion, and a bendable portion, the first arm portion being attached to the shaft so as to be unrotatable relative to the shaft, the second arm portion being provided at the wave receiving plate, the bendable portion being configured to couple the first arm portion and the second arm portion to each other;

when a swing angle of the first arm portion is less than a first predetermined angle, the bendable portion makes the first arm portion and the second arm portion swing integrally; and when the swing angle of the first arm portion is the predetermined angle, the bendable portion allows the second arm portion to bend relative to first arm portion.

2. The wave receiving mechanism according to claim 1, wherein:

the bendable portion includes an engaging portion and an engaged portion, the engaging portion being provided at one of the first arm portion and the second arm portion, the engaged portion being provided at the other of the first arm portion and the second arm portion and configured to be engaged with the engaging portion;

when the engaging portion and the engaged portion are engaged with each other, the bendable portion makes the first arm portion and the second arm portion swing integrally; and when the engaging portion and the engaged portion are disengaged from each other, the bendable portion allows the second arm portion to bend relative to the first arm portion.

3. The wave receiving mechanism according to claim 2, further comprising a disengaging member configured to:

contact the bendable portion of the swinging wave receiving member; and when the first arm portion swings with the disengaging member contacting the bendable portion, make the engaging portion and the engaged portion be displaced relative to each other, and with this, disengage the engaging portion and the engaged portion from each other.

4. The wave receiving mechanism according to claim 3, wherein:

a portion of one of the engaging portion and the engaged portion includes a roller supported so as to be turnable, the other of the engaging portion and the engaged portion being engaged with the portion of the one of the engaging portion and the engaged portion; and when disengaging the engaging portion and the engaged portion from each other, the roller rolls on the other of the engaging portion and the engaged portion.

5. The wave receiving mechanism according to claim 1, further comprising a stopper member configured to, when the first arm portion swings at a second predetermined angle that is the first predetermined angle or more, contact the first arm portion to restrict the swinging of the first arm portion.

6. The wave receiving mechanism according to claim 1, further comprising a flexible joint by which a wave receiving shaft that is the shaft and a pump shaft of the hydraulic pump are coupled to each other such that an axis of the wave receiving shaft and an axis of the pump shaft are parallel to each other, wherein the flexible joint allows the wave receiving shaft to be displaced relative to the pump shaft in directions perpendicular to the axis.

7. The wave receiving mechanism according to claim 2, further comprising a stopper member configured to, when the first arm portion swings at a second predetermined angle that is the first predetermined angle or more, contact the first arm portion to restrict the swinging of the first arm portion.

8. The wave receiving mechanism according to claim 3, further comprising a stopper member configured to, when the first arm portion swings at a second predetermined angle that is the first predetermined angle or more, contact the first arm portion to restrict the swinging of the first arm portion.

9. The wave receiving mechanism according to claim 4, further comprising a stopper member configured to, when the first arm portion swings at a second predetermined angle that is the first predetermined angle or more, contact the first arm portion to restrict the swinging of the first arm portion.

10. The wave receiving mechanism according to claim 2, further comprising a flexible joint by which a wave receiving shaft that is the shaft and a pump shaft of the hydraulic pump are coupled to each other such that an axis of the wave receiving shaft and an axis of the pump shaft are parallel to each other, wherein the flexible joint allows the wave receiving shaft to be displaced relative to the pump shaft in directions perpendicular to the axis.

11. The wave receiving mechanism according to claim 3, further comprising a flexible joint by which a wave receiving shaft that is the shaft and a pump shaft of the hydraulic pump are coupled to each other such that an axis of the wave receiving shaft and an axis of the pump shaft are parallel to each other, wherein the flexible joint allows the wave receiving shaft to be displaced relative to the pump shaft in directions perpendicular to the axis.

12. The wave receiving mechanism according to claim 4, further comprising a flexible joint by which a wave receiving shaft that is the shaft and a pump shaft of the hydraulic pump are coupled to each other such that an axis of the wave receiving shaft and an axis of the pump shaft are parallel to each other, wherein the flexible joint allows the wave receiving shaft to be displaced relative to the pump shaft in directions perpendicular to the axis.

13. The wave receiving mechanism according to claim 5, further comprising a flexible joint by which a wave receiving shaft that is the shaft and a pump shaft of the hydraulic pump are coupled to each other such that an axis of the wave receiving shaft and an axis of the pump shaft are parallel to each other, wherein the flexible joint allows the wave receiving shaft to be displaced relative to the pump shaft in directions perpendicular to the axis.

14. The wave receiving mechanism according to claim 7, further comprising a flexible joint by which a wave receiving shaft that is the shaft and a pump shaft of the hydraulic pump are coupled to each other such that an axis of the wave receiving shaft and an axis of the pump shaft are parallel to each other, wherein the flexible joint allows the wave receiving shaft to be displaced relative to the pump shaft in directions perpendicular to the axis.

15. The wave receiving mechanism according to claim 8, further comprising a flexible joint by which a wave receiving shaft that is the shaft and a pump shaft of the hydraulic pump are coupled to each other such that an axis of the wave receiving shaft and an axis of the pump shaft are parallel to each other, wherein the flexible joint allows the wave receiving shaft to be displaced relative to the pump shaft in directions perpendicular to the axis.

16. The wave receiving mechanism according to claim 9, further comprising a flexible joint by which a wave receiving shaft that is the shaft and a pump shaft of the hydraulic pump are coupled to each other such that an axis of the wave receiving shaft and an axis of the pump shaft are parallel to each other, wherein the flexible joint allows the wave receiving shaft to be displaced relative to the pump shaft in directions perpendicular to the axis.

* * * * *